US006245480B1

(12) United States Patent
Bogie et al.

(10) Patent No.: US 6,245,480 B1
(45) Date of Patent: Jun. 12, 2001

(54) HIGH CONTRAST PHOTOGRAPHIC ELEMENT CONTAINING A NOVEL NUCLEATOR

(75) Inventors: Judith A. Bogie, Hertfordshire; Philip J. Coldrick, Middlesex; John D. Goddard, Pinner; Llewellyn J. Leyshon, Hertfordshire, all of (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/591,774

(22) Filed: Jun. 12, 2000

Related U.S. Application Data

(63) Continuation-in-part of application No. 09/444,777, filed on Nov. 22, 1999, now Pat. No. 6,143,462.

(30) Foreign Application Priority Data

Dec. 8, 1998 (GB) ..... 9826870

(51) Int. Cl.[7] ..... G03C 1/08
(52) U.S. Cl. ..... 430/264
(58) Field of Search ..... 430/264

(56) References Cited

U.S. PATENT DOCUMENTS

| | | | |
|---|---|---|---|
| 4,030,925 | 6/1977 | Leone et al. . | |
| 4,031,127 | 6/1977 | Leone et al. . | |
| 4,269,929 | 5/1981 | Nothnagle et al. . | |
| 4,278,748 | 7/1981 | Sidhu et al. . | |
| 4,323,643 | 4/1982 | Mifune et al. . | |
| 4,668,605 | 5/1987 | Okutsu et al. . | |
| 4,740,452 | 4/1988 | Okutsu et al. . | |
| 5,288,590 | 2/1994 | Kuwabara et al. . | |
| 5,316,889 | 5/1994 | Sakai et al. . | |
| 5,695,909 | 12/1997 | Oya et al. . | |
| 5,744,279 | 4/1998 | Ezoe et al. . | |
| 5,962,212 | 10/1999 | Suzuki et al. . | |
| 6,143,462 * | 11/2000 | Goddard et al. | 430/264 |

FOREIGN PATENT DOCUMENTS

| | | |
|---|---|---|
| 0 333 435 | 8/1981 | (EP) . |
| 0 364 166 | 4/1990 | (EP) . |
| 0 598 315 | 5/1994 | (EP) . |
| 95/32453 | 11/1995 | (WO) . |

* cited by examiner

*Primary Examiner*—Hoa Van Le
(74) *Attorney, Agent, or Firm*—Edith A. Rice

(57) ABSTRACT

The invention relates to an ultrahigh contrast photographic material comprising a support bearing a silver halide emulsion layer, containing a hydrazide nucleating agent in the emulsion layer or a hydrophilic colloid layer, characterised in that the nucleating agent of formula (I) comprises (a) two nicotinamide moieties, which may be the same or different, which are linked by a linking group, and (b) a hydrazide moiety linked to only one of the nicotinamide moieties. The nucleator of formula (I) may be in combination with a nucleator of formula (II) which comprises a dimeric molecule comprising two monomers linked by a linking group, each monomer of which (a) may be the same or different and (b) comprises a hydrazide moiety and a nicotinamide moiety.

The photographic material provides unexpectedly good nucleation in the absence of, or with reduced amounts of, booster and in a developer whose pH is variable, and further with lower chemical spread and pepper fog. When the synthesis provides both a compound of formula (I) and (II), the products can be used directly without a separation step, providing a cost advantage.

27 Claims, No Drawings

HIGH CONTRAST PHOTOGRAPHIC ELEMENT CONTAINING A NOVEL NUCLEATOR

This application is a continuation-in-part of application Ser. No. 09/444,777, filed Nov. 22, 1999, now U.S. Pat. No. 6,143,462.

FIELD OF THE INVENTION

This invention relates to high contrast photographic silver halide materials and in particular to those of the graphic arts type and is related to copending European Patent application no. 99204096.4.

BACKGROUND OF THE INVENTION

In the field of graphic arts, an ultrahigh contrast photographic material is required for achieving satisfactory halftone dot reproduction of a continuous tone or reproduction of a line image in the process of making a lithographic printing plate. For many years these ultrahigh contrast photographic images were obtained by developing a 'lith' emulsion (usually high in silver chloride content) in a hydroquinone, low sulphite, 'lith' developer by the process known as infectious development. However, such low sulphite developers are inherently unstable and are particularly inappropriate for machine processing.

More recently an image formation system providing ultrahigh contrast where the gamma (contrast) exceeds 10 has been provided conventionally in a material wherein silver halide bearing a surface latent image is developed in the presence of a hydrazine (also known as a nucleating agent), specifically an acylhydrazine, which can be incorporated into the photographic material or into the developer. The pH of the developer solution is usually in the range 10.0 to 12.3, typically about 11.5, and the developer includes conventional amounts of sulphite, hydroquinone and possibly metol or a pyrazolidone. While such a process is better than the low sulphite 'lith' process, the developer still has a high pH requirement for it to function correctly. Such a solution is not as stable as is desirable. Additionally, high pH solutions are environmentally undesirable because of the care needed in handling and disposing of the effluent.

Unfortunately, light sensitive materials whose contrast is enhanced by the presence of a hydrazine nucleating agent show large variations in their photographic properties as the developer is exhausted or through the course of time, for example as the pH of the developer varies and in particular as the pH is lowered. The pH of the developer can vary for a number of reasons: for example, exhaustion and absorption of carbon dioxide causes the pH to drop whilst air oxidation causes the pH to rise, as can concentration through evaporation.

It is also known that a developer solution having a pH below 11 can be employed by using certain hydrazides active at this pH. Hydrazides proposed for such use are described, for example, in U.S. Pat. Nos. 4,278,748; 4,031,127; 4,030,925 and 4,323,643 and in EP-A-0 333 435. A nucleator containing both a hydrazide moiety and a nicotinamide moiety is disclosed in U.S. Pat. No. 5,288,590.

Developer solutions with these low pHs can also be used by the introduction of a contrast-promoting agent (commonly called a booster) to give adequate activity. The booster can be incorporated into the photographic layer or may be dissolved in the developer solution. The booster may be, for example, one of the boosters as described in U.S. Pat. No. 5,316,889 or an amine booster as described in U.S. Pat. Nos. 4,269,929; 4,668,605, 4,740,452 or EP-A-0 364 166. Compounds bearing different functionalities e.g. phosphonium and pyridinium, have also been shown to be active, as described in U.S. Pat. No. 5,744,279.

The disadvantages connected with the necessity of using a booster to promote nucleation are numerous. Some materials are toxic, some are excessively volatile, some have unpleasant odours, some tend to form azeotropes with water, some build up in the developer during processing, some are insufficiently soluble in an aqueous alkaline photographic developing solution and some are costly, yet must be used at a relatively high concentration, thereby contributing substantially to the overall cost of the material. Moreover, many boosters exhibit a degree of activity as contrast-promoters that is less than is desired for commercial operation. In addition, a photographic system depending on the combination of nucleator and booster is an exceedingly complex system which makes its performance particularly sensitive to variation. It would be desirable therefore if good nucleation could be achieved in the absence of such a booster or with a reduced amount of such a booster.

In the non-image areas on the processed film unwanted small dots can appear and this is called 'pepper fog'. This is due to unintentionally fogged grains developing and being amplified by the nucleation process and being rendered visible. Nucleators which are unstable or more active and diffuse more rapidly can result in more and larger pepper fog spots. In high contrast materials therefore a balance needs to be achieved between vigorous development and pepper fog.

Another consideration is chemical spread (or image spread) which is a measure of the increase in size of developed dots or lines produced by nucleation of the edge of the image area causing development of the image boundary beyond the original exposed edge. This spread is small but measurable and can reduce the resolution of very fine lines.

PROBLEM TO BE SOLVED BY THE INVENTION

The problem is therefore to provide a nucleator for incorporation into a photographic material or into the developer which gives ultrahigh contrast but which at the same time shows less sensitivity to variations in the developing conditions, such as pH or development time, provides sufficient activity in the presence of reduced amounts of a booster or ideally in the absence of booster, provides lower chemical spread and has significantly reduced pepper fog in the photographic material.

It has been found that these objectives can be achieved by the use of a nucleating agent comprising (a) two nicotinamide moieties, which may be the same or different, which are linked by a linking group, and (b) a hydrazide moiety linked to only one of those nicotinamide moieties. Such a nucleating agent can lead to unexpectedly good nucleation even in the absence of a booster and also in a developer whose pH is variable, with concomitant lower chemical spread and pepper fog.

SUMMARY OF THE INVENTION

According to the present invention therefore there is provided an ultrahigh contrast photographic material comprising a support bearing a silver halide emulsion layer, containing a hydrazide nucleating agent in the emulsion layer or a hydrophilic colloid layer, characterised in that the nucleating agent of formula (I) comprises (a) two nicotinamide moieties, which may be the same or different, which are linked by a linking group, and (b) a hydrazide moiety linked to only one of the nicotinamide moieties.

In another aspect of the invention there is provided an ultrahigh contrast photographic material comprising a support bearing a silver halide emulsion layer, containing a hydrazide nucleating agent in the emulsion layer or a hydrophilic colloid layer, characterised in that the nucleating agent of formula (I), as hereinbefore defined, is in combination with a nucleating agent of formula (II), which comprises a dimeric molecule comprising two monomers linked by a linking group, each monomer of which (a) may be the same or different and (b) comprises a hydrazide moiety and a nicotinamide moiety.

In a further aspect of the invention there is provided an ultrahigh contrast photographic material, as hereinbefore defined, which also contains in the emulsion layer or a hydrophilic colloid layer, a booster compound, as hereinafter defined.

In yet another aspect of the invention there is provided a process of forming a photographic image having ultrahigh contrast which comprises imagewise exposing a photographic material comprising a support bearing a silver halide emulsion layer and processing it with an alkaline developer solution, characterised in that it is developed in the presence of a nucleating agent comprising either a compound of formula (I), or a compound of formula (I) in combination with a compound of formula (II), optionally in the presence of a booster compound, as hereinafter defined.

ADVANTAGEOUS EFFECT OF THE INVENTION

The nucleating agents for use in the invention show less sensitivity to variation in the development conditions than do conventional nucleating agents, leading to significant improvements in processing robustness. Furthermore they are found to provide sufficient activity in the presence of less than the normal amount of booster or even in the absence of such a booster, with cost and environmental advantages. Additionally they provide lower chemical spread and significantly reduced or no observable pepper fog in the photographic material.

A further benefit resides in that, when the synthesis provides both a compound of formula (I) and a compound of formula (II), the products thereby obtained can be used directly, without the necessity of a separation step, leading to a cost advantage.

DETAILED DESCRIPTION OF THE INVENTION

The nucleators of formula (I) for use in photographic materials of the invention preferably have one of the following general formulae:

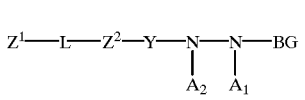

$(T)_n$ or

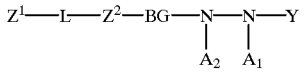

$(T)_n$ wherein $Z^1$ and $Z^2$ are the same or different and each is a nicotinamide residue, at least one of which is positively charged;

Y is a substituted aryl or heterocyclic ring;

one of $A_1$ and $A_2$ is a hydrogen atom and the other is a hydrogen atom, an acyl group or an alkyl- or arylsulfonyl group, any of which groups may be substituted;

BG is a blocking group;

L is a linking group;

T is an anionic counterion and n is 1 or 2.

The nucleators of formula (II), which may be used in combination with a nucleator of formula (I), have one of the following general formulae:

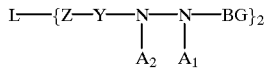

2T or

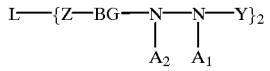

2T wherein each monomer liked by linking group L is the same or different;

Z is a positively charged nicotinamide residue; and

Y, $A_1$, $A_2$, BG, L and T are as defined for a compound of formula (I).

In a preferred embodiment each of $A_1$ and $A_2$ in compounds of formula (I) and (II) is a hydrogen atom.

More preferably the nucleating agent of formula (I) has one of the following formulae A, B or C, formula A being the most preferred:

(A)

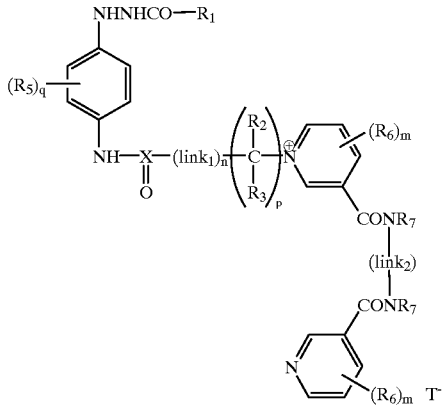

(B)

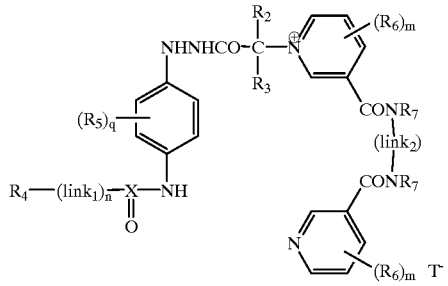

-continued (C)

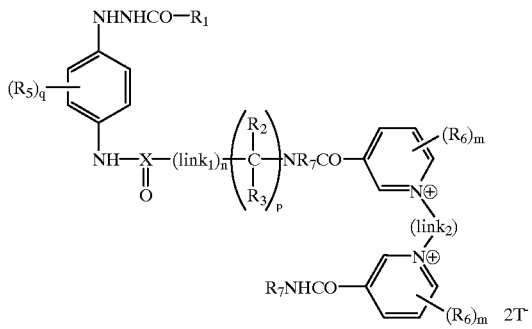

More preferably the nucleating agent of formula (II) has one of the following formulae D, E or F, formula D being the most preferred.

(D)

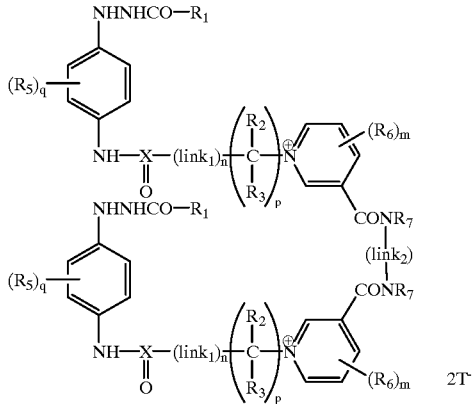

(E)

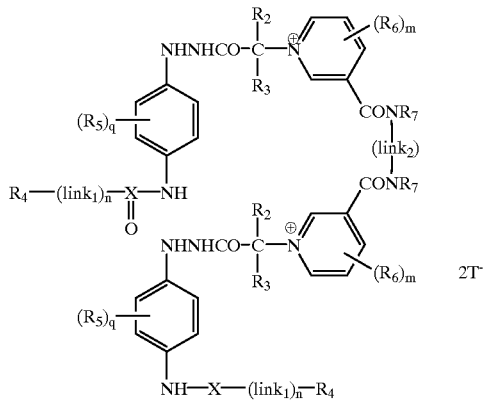

-continued (F)

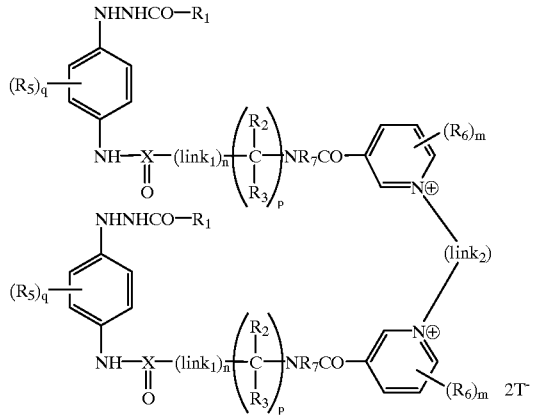

In these embodiments, each $R_1CO$ comprises a blocking group and in particular each $R_1$, which in the compound of formula (II) is the same or different, is independently selected from a hydrogen atom, and an unsubstituted or substituted alkyl, aryl, alkoxy, aryloxy, alkoxy- or aryloxy-carbonyl and alkyl- or aryl-aminocarbonyl group; or each $R_1$ is or contains an unsubstituted or substituted heterocyclic group, having a 5- or 6-membered ring containing at least one nitrogen, oxygen or sulfur atom, wherein the ring may be linked either directly to the carbonyl group or via an alkyl, alkoxy, carbonyl, amino- or alkylamino-carbonyl group and wherein the ring may be fused to an unsubstituted or substituted benzene ring;

each $R_2$ and $R_3$, which in a compound of formula (II) are the same or different, is independently selected from hydrogen and an unsubstituted or substituted alkyl or aryl group and p is 0 or 1;

each $R_4$ and $R_5$, which in a compound of formula (II) are the same or different, and each $R_6$, which may be the same or different, is independently selected from hydrogen, halogen, hydroxy, cyano and an unsubstituted or substituted alkyl, aryl, heterocyclyl, alkoxy, acyloxy, aryloxy, carbonamido, sulfonamido, ureido, thioureido, semicarbazido, thiosemicarbazido, urethane, quaternary ammonium, alkyl- or aryl-thio, alkyl- or aryl-sulfonyl, alkyl- or aryl-sulfinyl, carboxyl, alkoxy- or aryloxy-carbonyl, carbamoyl, sulfamoyl, phosphonamido, diacylamino, imido or acylurea group, a group containing a selenium or a tellurium atom and a group having a tertiary sulfonium structure;

each m is the same or different and is an integer from 0 to 4;

each q, which in the compound of formula (II) is the same or different, is an integer from 0 to 4;

each $R_7$ is the same or different and is independently selected from hydrogen and an unsubstituted or substituted alkyl or aryl group;

each X, which in the compound of formula (II) is the same or different, is independently selected from C, S═O and C—NH;

each ($link_1$), which in the compound of formula (II) is the same or different, is independently selected from an unsubstituted or substituted alkylene, polyalkylene, aryl, arylaminocarbonyl or heterocyclyl group and each n is 0 or 1; and each ($link_2$) is a linking group independently selected from an unsubstituted or substituted polyalkylene, polyalkylene oxide, polyalkylene containing one or more heteroatoms selected from nitrogen, oxygen and sulfur, separated from each other by alkylene groups, or an unsubstituted or substituted polyalkylene in which the alkylene groups are separated by an unsubstituted or substituted aryl or heterocyclic ring and $T^-$ is an anionic counterion.

As used herein and throughout the specification the term alkyl refers to an unsaturated or saturated straight or branched chain alkyl group (including alkenyl) having 1–20 atoms and includes cycloalkyl having 3–8 carbon atoms. The term aryl includes aralkyl (and specifically fused aryl within its scope). The term heterocyclic specifically includes fused heterocyclic within its scope. The term polyalkylene is defined as the group $(CH_2)_n$ wherein n is an integer from 2 to 50.

The term 'blocking group' refers to a group suitable for protecting the (hydrazine) group but which is readily removable when necessary.

It is preferred that $R_1$ is a hydrogen atom or a group selected from unsubstituted or substituted alkyl, for example methyl, trifluoromethyl, 3-methylsulfonamidopropyl, methyl- or phenyl-sulfonylmethyl, carboxytetrafluoroethyl; unsubstituted or substituted aryl, for example phenyl, 3,5-di-chlorophenyl, o-methanesulfonamidophenyl, 4-methanesulfonylphenyl, 2(2'-hydroxyethyl)phenyl, 2-hydroxy-4-methylphenyl, 2-hydroxymethylphenyl, o-hydroxybenzyl; a carbonyl-containing group, for example an alkylamino-, alkoxy-, aryloxy- or hydroxyalkylamino-carbonyl; or contains an imidazolyl, pyrazolyl, triazolyl, tetrazolyl, pyridyl, pyridinium, piperidinyl, morpholino, quinolinium or a quinolinyl group or $R_1$ may include a group which splits off a photographically useful fragment, such as a phenylmercaptotetrazole or a 5- or 6-nitroindazole group. Examples of some of these are disclosed in U.S. Pat. No. 5,328,801.

More preferably $R_1$ contains a morpholino group and especially has the formula —$CONH(CH_2)_n$-morpholino, wherein n is 0–4 and is conveniently 3.

$R_2$ and $R_3$ are preferably hydrogen atoms or alkyl groups with p being preferably 1 and $R_4$, $R_5$ and $R_6$ are preferably hydrogen, alkyl, alkoxy, alkylthio, trifluoromethyl or methylsulfonamido groups, with q being preferably 0 or 1 and m being preferably 0. $R_7$ is preferably hydrogen or an alkyl group, optionally substituted with, for example, a dialkylamino group.

When X is S═O or C—NH it is preferred that n is 1 and that ($link_1$) comprises an arylamino group or an arylaminocarbonyl group, preferably a phenylaminocarbonyl group, which may be substituted in the ring, for example, with one or more alkyl, carboxyl groups or halogen atoms. When X is C it is preferred that n is 0 such that no ($link_1$) group is present.

The ($link_2$) group preferably comprises a polyalkylene group comprising alkylene groups, preferably methylene groups, typically four or six, which may be separated by one or more O or S atoms. For example ($link_2$) may be $(CH_2)_4$, $(CH_2)_6$, $(CH_2)_2S(CH_2)_2$ or $(CH_2)_2O(CH_2)_2O(CH_2)_2$. Alternatively ($link_2$) may be a polyalkylene oxide chain extending from an even number of methylene groups such as $(CH_2CH_2O)_{14}CH_2CH_2$ or may comprise, for example, a $CH_2C_6H_4CH_2$ group.

The anionic counterion may be selected from any well known in the art and may typically be selected from $Cl^-$, $Br^-$, $I^-$, $CF_3COO^-$, $CH_3SO_3^-$ and $TsO^-$.

Unless otherwise specifically stated, substituent groups usable on molecules herein include any groups, whether substituted or unsubstituted, which do not destroy properties necessary for photographic utility.

When the term "group" is applied to the identification of a substituent containing a substitutable hydrogen, it is intended to encompass not only the substituent's unsubstituted form, but also its form further substituted with any group or groups as herein mentioned.

Suitably, the group may be halogen or may be bonded to the remainder of the molecule by an atom of carbon, silicon, oxygen, nitrogen, phosphorus, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy) hexanamido, alpha-(4-hydroxy-3-t-butylphenoxytetradecanamido, 2-oxo-pyrrolidin-1-yl, 2-oxo-5-tetradecylpyrrolidin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-di-propylsulfamoyl, N-hexadecylsulfamoyl, N,N-dimethylsulfamoyl; N-[3-(do-decyloxy)propyl]sulfamoyl, N-[4-(2,4-di-t-pentylphenoxybutyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy) butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imido, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups and groups which adsorb to silver halide. Generally, the above groups and substituents thereof may include those having up to 48 carbon atoms, typically 1 to 36 carbon atoms and usually less than 24 carbon atoms, but greater numbers are possible depending on the particular substituents selected.

Generally the synthesis of a compound of formula (I) will produce an amount of a compound of formula (II) in a greater or lesser amount. For the purpose of achieving the advantages of this invention it has been found surprisingly that a number of relative amounts of these two components can be used with advantage, without isolation of either component, providing a significant benefit in the synthesis thereof. Although not critical to the function of the invention, for ease of synthesis it is convenient if the compound of formula (II) comprises two identical moieties linked by $(link)_2$.

In some embodiments, the nucleators of the invention may be selected from the following:

Compounds of Formula (I)

(M1)

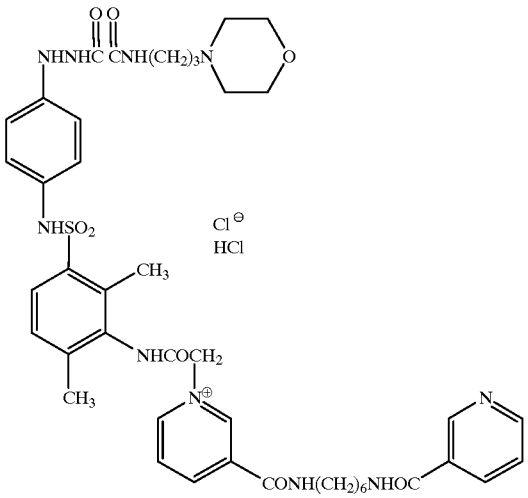

(M2)

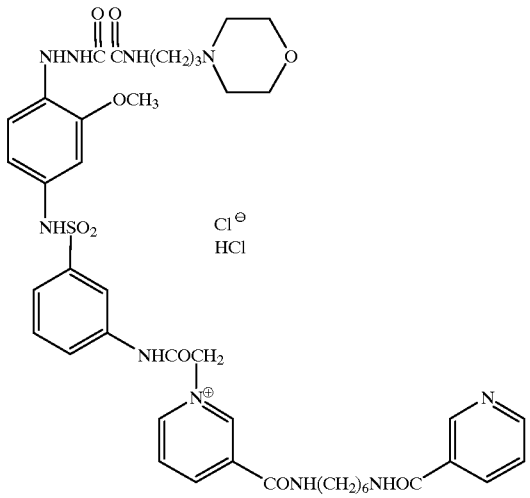

-continued
(M3)
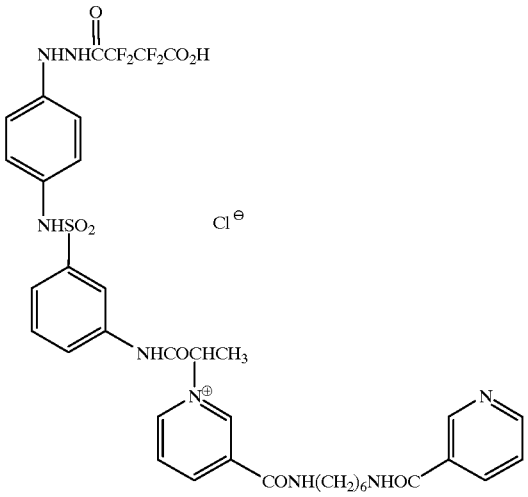
(M4)
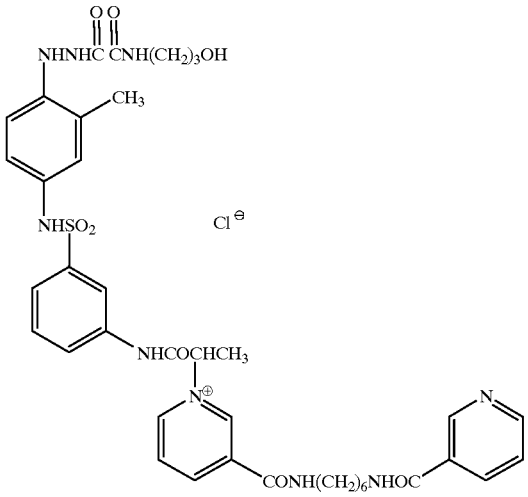
(M5)
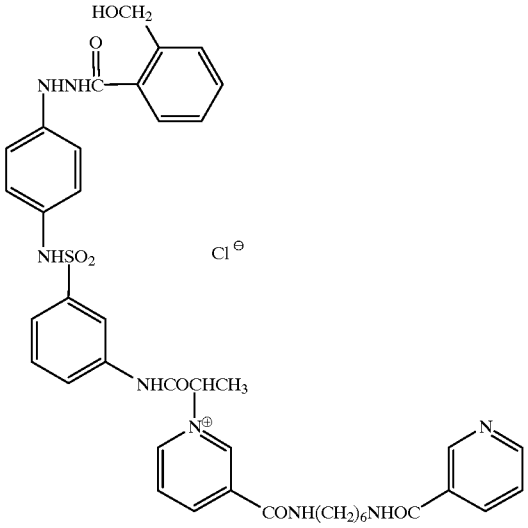
(M6)
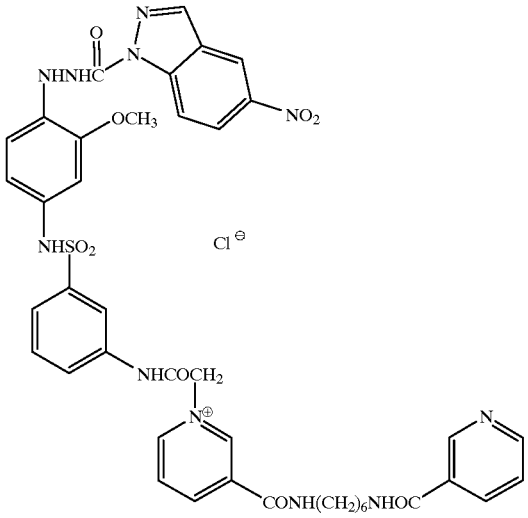
(M7)
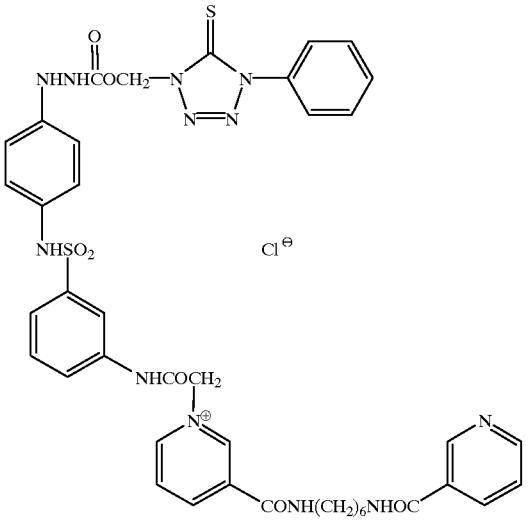
(M8)
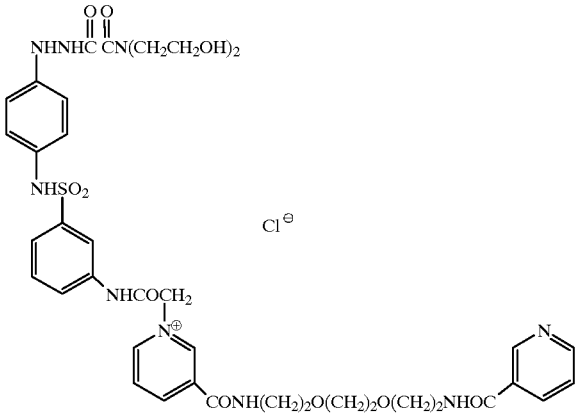

-continued
(M9)
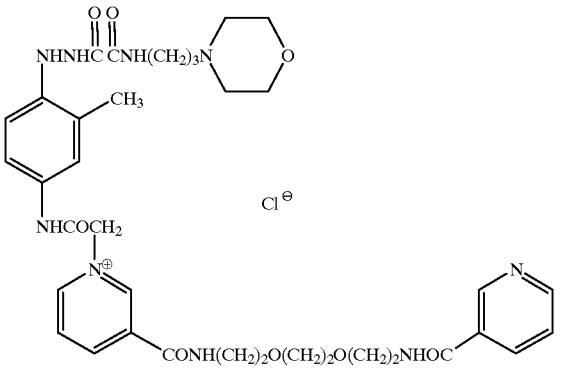
(M10)
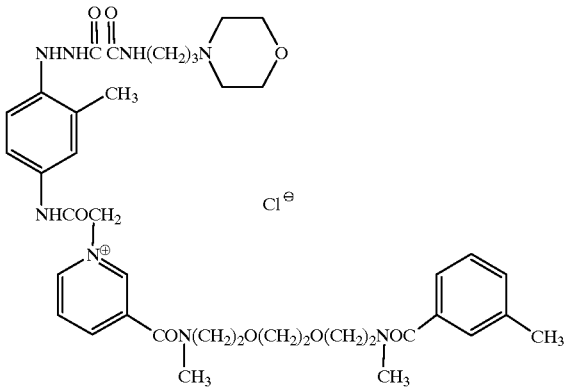
(M11)
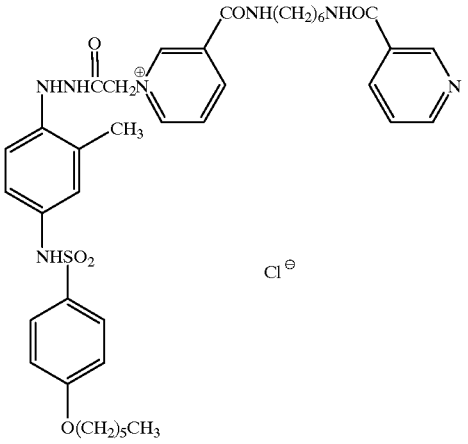
(M12)
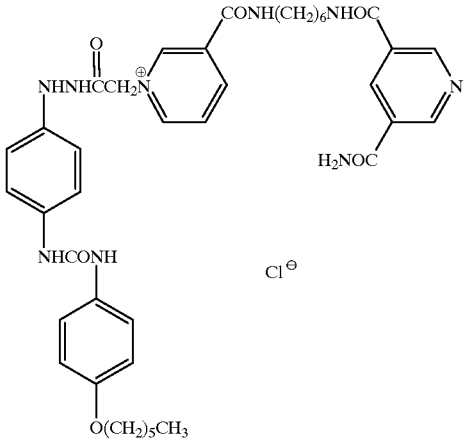
(M13)
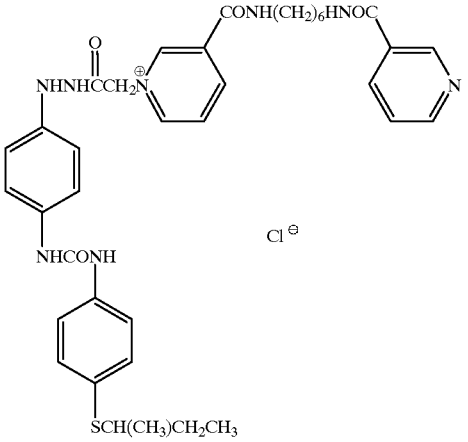
(M14)
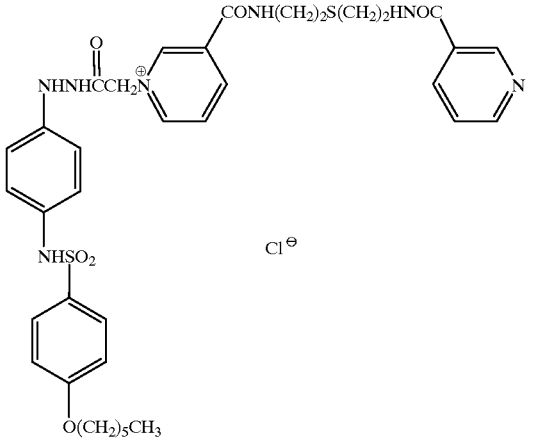

-continued
(M15)
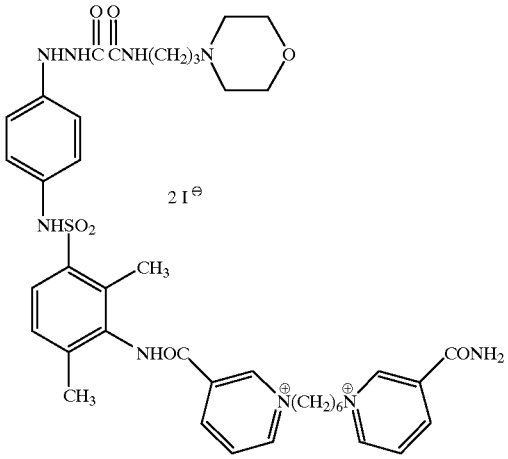
(M16)
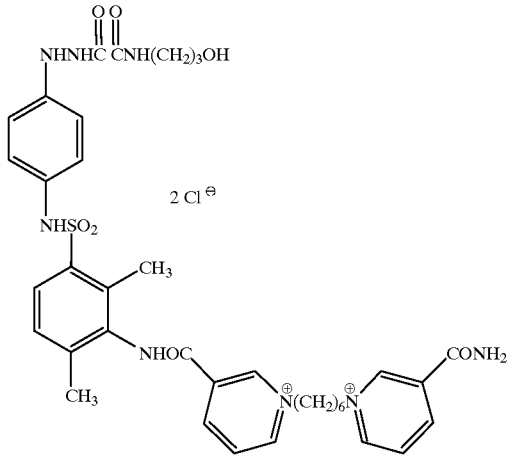
(M17)
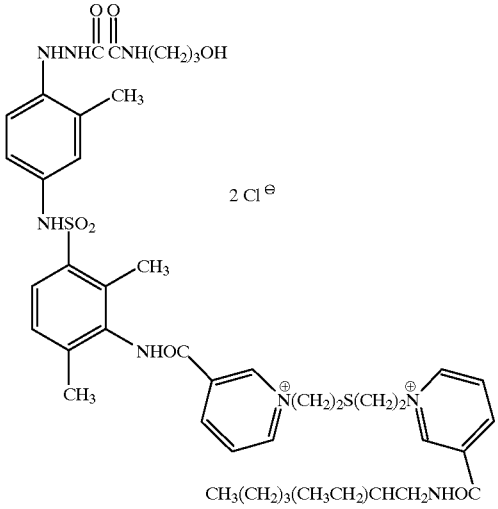
(M18)
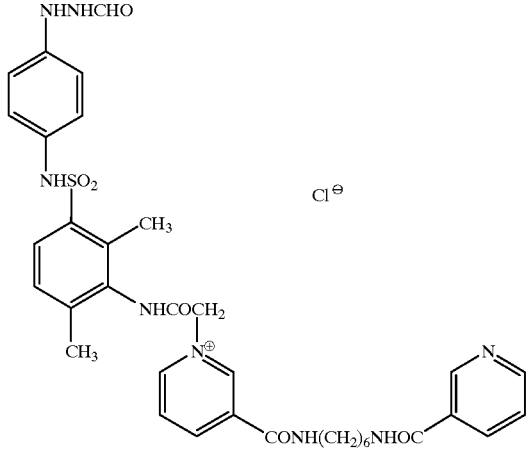
(M19)
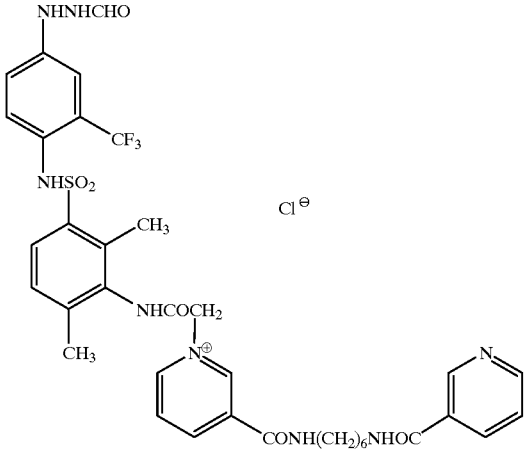
(M20)
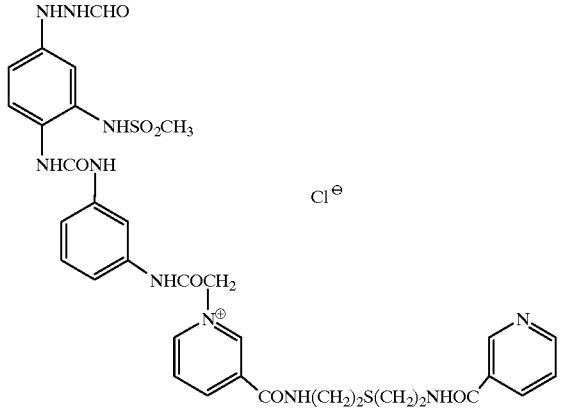

-continued
(M21)
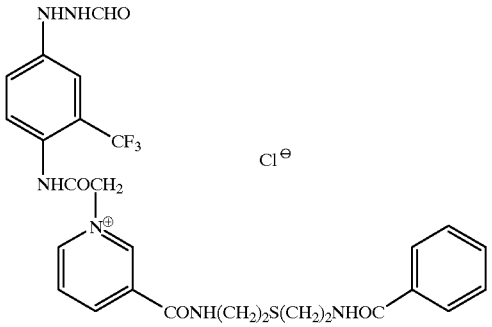
(M22)
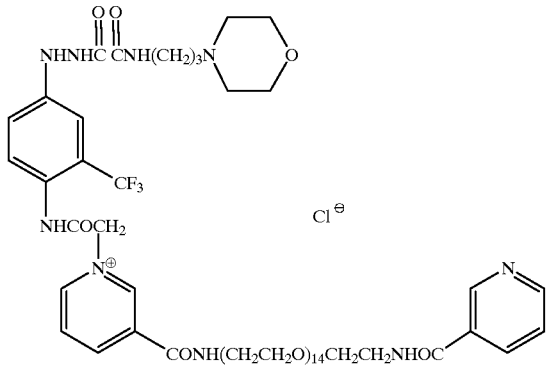
Compounds of formula (II)
(N1)
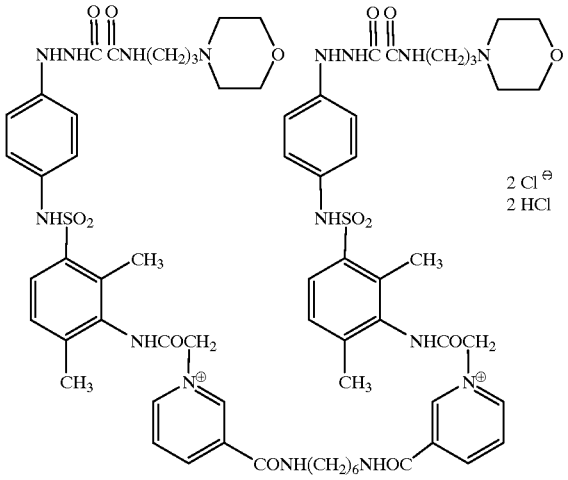
(N2)
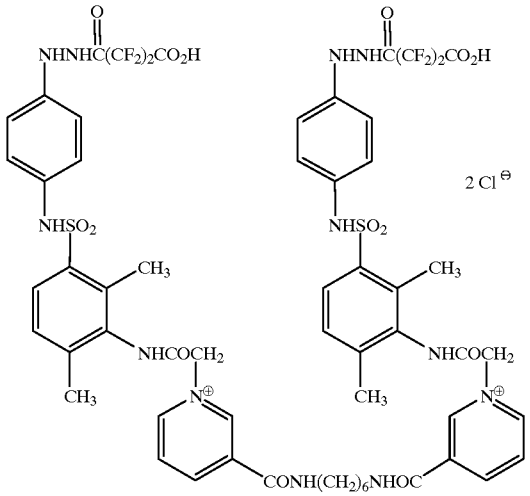
(N3)
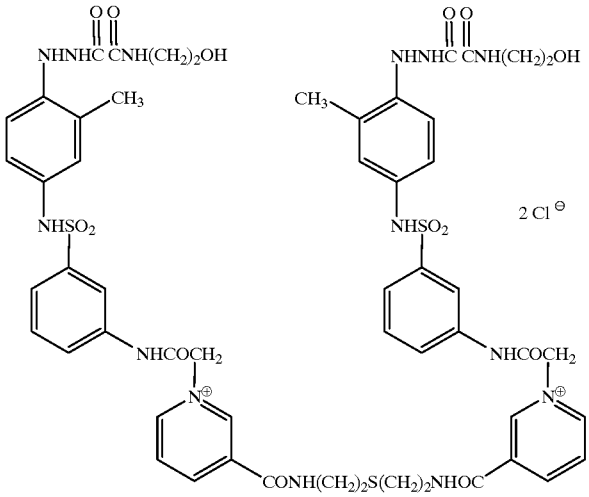

-continued
(N4)
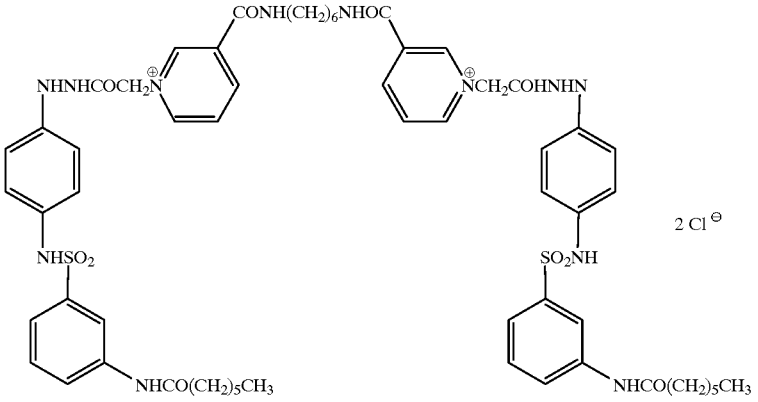
(N5)
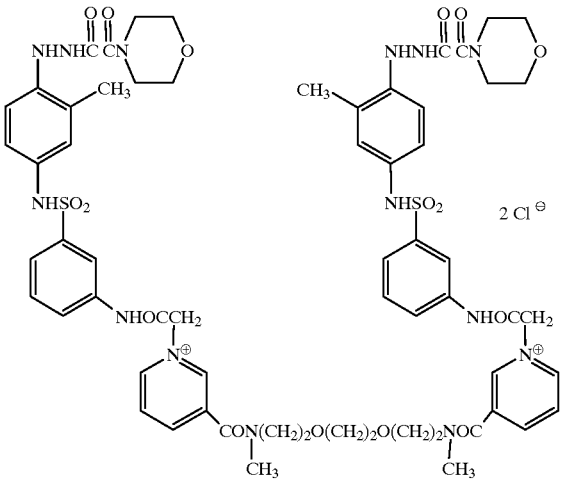
(N6)
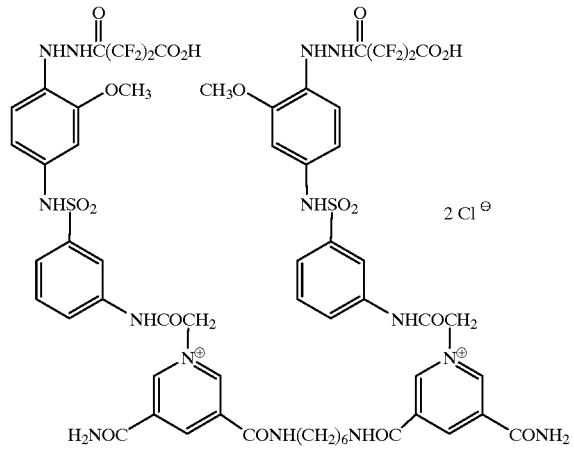
(N7)
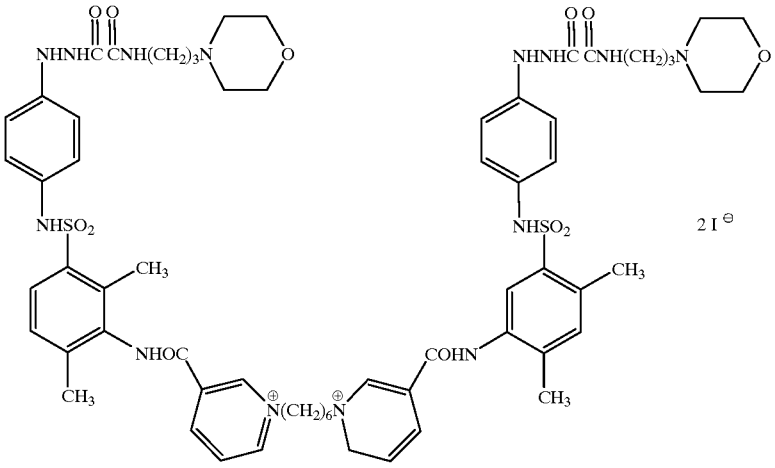

-continued (N8)

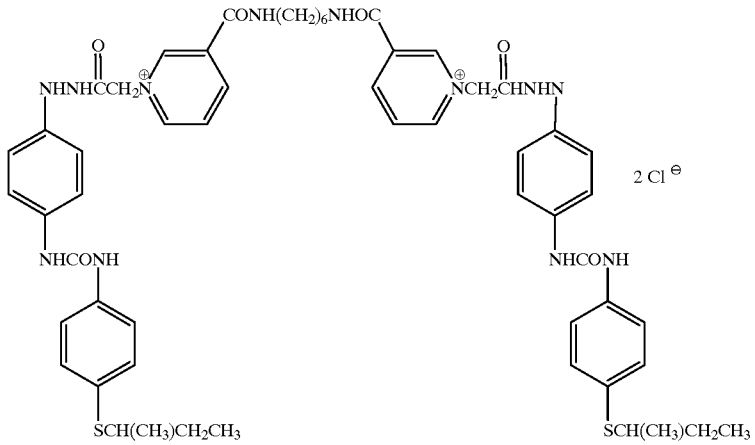

The photographic material of the invention may also contain a booster compound to enhance the ultrahigh contrast and to promote activity, although as previously mentioned the use of the nucleators described herein means that the amount of any such booster can be substantially reduced. Alternatively the booster compound can be present in the developer solution.

One class of such boosters are amines which (1) comprise at least one secondary or tertiary amino group, and (2) have an n-octanol/water partition coefficient (log P) of at least one, preferably at least three, and most preferably at least four, log P being defined by the formula:

$$logP = \log\frac{[X_{octanol}]}{[X_{water}]}$$

wherein X is the concentration of the amino compound.

Preferably such an amine contains within its structure a group comprising at least three repeating ethyleneoxy units as described in U.S. Pat. No. 4,975,354. These units are preferably directly attached to the nitrogen atom of a tertiary amino group.

Included within the scope of the amino compounds which may be utilised in this invention are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amine boosters are compounds having at least 20 carbon atoms.

Preferred amino compounds for inclusion in photographic materials of the invention are bis-tertiary amines which have a partition coefficient of at least three and a structure represented by the formula:

$$R^1R^2N—(CH_2CH_2O)_n—CH_2CH_2—NR^3R^4$$

wherein n is an integer from 3 to 50, and more preferably 10 to 50;

$R^1$, $R^2$, $R^3$ and $R^4$ are, independently, alkyl groups of 1 to 8 carbon atoms, or $R^1$ and $R^2$ taken together represent the atoms necessary to complete a heterocyclic ring, and/or $R^3$ and $R^4$ taken together represent the atoms necessary to complete a heterocyclic ring.

A particularly preferred booster for use in photographic materials of the invention or in the developer therefor is the booster B1 wherein in the above formula $R^1$, $R^2$, $R^3$ and $R^4$ are each n-propyl groups and n is 14, i.e. the structure:

(B1)

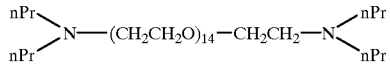

Another preferred group of amino compounds is that of bis-secondary amines which have a partition coefficient of at least three and a structure represented by the formula:

$$RHN(CH_2CH_2O)_n—CH_2CH_2—NHR$$

wherein n is an integer from 3 to 50, and more preferably 10 to 50, and each R is, independently, a linear or branched, substituted or unsubstituted, alkyl group of at least 4 carbon atoms.

Particular amines suitable as booster compounds are listed in EP-A-0 364 166.

Other types of boosters are described in U.S. Pat. No. 5,744,279 as having one of the formulae:

$$Y((X)_n—A—B)_m \quad (a)$$

wherein

Y is a group which adsorbs to silver halide,

X is a divalent linking group composed of hydrogen, carbon, nitrogen and sulfur atoms, A is a divalent linking group, B is an amino group which may be substituted or an ammonium group of a nitrogen-containing heterocyclic group, m is 1, 2 or 3 and n is 0 or 1, $$R^1R^2N—R^3—(X)_n—SM_x \quad (b)$$

wherein $R^1$ and $R^2$ are each hydrogen or an aliphatic group, or $R^1$ and $R^2$ may together form a ring, $R^3$ is a divalent aliphatic group, X is a divalent heterocyclic ring having at least one nitrogen, oxygen or sulfur atom as heteroatom, n is 0 or 1, M is hydrogen or an alkali metal atom, alkaline earth metal atom, a quaternary ammonium, quaternary phosphonium atom or an amidino group, and x is 1 when M is a divalent atom;

said compound optionally being in the form of an addition salt;

a phosphonium structure as disclosed in col. 8 of U.S. Pat. No. 5,744,279 and as exemplified by the following formula:

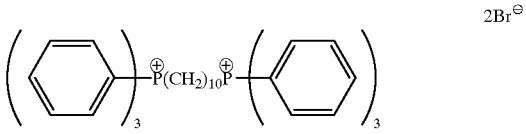

or a pyridinium structure as disclosed in col. 21 of the afore-mentioned U.S. patent as exemplified by the following formula:

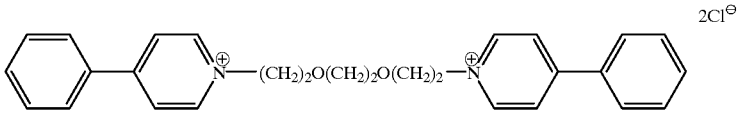

The nucleator(s) and optionally the booster compound can be incorporated in the photographic element, for example in a silver halide emulsion layer. Alternatively they can be present in a hydrophilic colloid layer of the photographic element, preferably a hydrophilic layer which is coated to be adjacent to the emulsion layer in which the effects of the nucleator are desired. They can however be present in the photographic element distributed between or among emulsion and hydrophilic colloid layers, such as undercoating layers, interlayers and overcoating layers.

Typically the nucleator(s) may be present in the photographic material in a total amount of from about 1 $\mu$mol/m$^2$ to about 100 $\mu$mol/m$^2$, preferably 3 $\mu$mol/m$^2$ to 50 $\mu$mol/m$^2$, more preferably 5 $\mu$mol/m$^2$ to 20 $\mu$mol/m$^2$. Corresponding amounts for the booster are from 0 mol/m$^2$ to about 1 mmol/m$^2$, preferably 10 $\mu$mol/m$^2$ to 100 $\mu$mol/m$^2$, most preferably 30 $\mu$mol/m$^2$ to 100 $\mu$mol/m$^2$.

When a compound of formula (I) is in combination with a compound of formula (II), any relative proportions of the components may achieve the advantages of the invention. However preferably the amount of compound of formula (I): compound of formula (II) is in the range from about 10:90 to about 90:10, preferably from about 20:80 to about 80:20. Conveniently however for simplicity of synthesis the compound of formula (II) is produced in excess and generally the relative amounts of the components are then in the range about 15:85 to about 30:70.

The emulsions employed in photographic materials of the invention and the addenda added thereto, the binders, supports etc. may be as described in Research Disclosure Item 36544, September 1994, published by Kenneth Mason Publications, Emsworth, Hants, PO10 7DQ, United Kingdom, which will be identified hereinafter by the term "Research Disclosure."

The hydrophilic colloid may be gelatin or a gelatin derivative, polyvinylpyrrolidone or casein and may contain a polymer. Suitable hydrophilic colloids and vinyl polymers and copolymers are described in Section IX of the Research Disclosure. Gelatin is the preferred hydrophilic colloid.

The photographic materials may also contain an overcoat hydrophilic colloid layer which may also contain a vinyl polymer or copolymer located as the last layer of the coating (furthest from the support). It contains one or more surfactants to aid coatability and may also contain some form of matting agent. The vinyl polymer is preferably an acrylic polymer and preferably contains units derived from one or more alkyl or substituted alkyl acrylates or methacrylates, alkyl or substituted alkyl acrylamides, or acrylates or acrylamides containing a sulfonic acid group.

The photographic materials of the invention preferably contain an antihalation layer which may be on either side of the support, preferably on the opposite side of the support from the emulsion layer. In a preferred embodiment an antihalation dye is contained in the hydrophilic colloid underlayer. The dye may also be dissolved in or dispersed in the underlayer. Suitable dyes are listed in the Research Disclosure disclosed above.

The emulsions are preferably chemically sensitised, for example with both sulfur and gold. The latent-image forming grains can be bromoiodide, chlorobromoiodide, bromide, chlorobromide, chloroiodide or chloride, preferably chlorobromide. They should be preferably be spectrally sensitised. More than one type of spectrally sensitised silver halide grain may be present and hence grains sensitised to different spectral regions may be present in the emulsion layer.

The coating may be made by blending two or more emulsion melts containing grains of the required spectral sensitivity, allowing the production of multi-wavelength sensitive products and giving rise to manufacturing cost advantages through both material and inventory reduction. Combining the different emulsion grains within one layer can give improvements in process sensitivity over multilayer graphics nucleated systems, as described in EP-A-0 682 288.

The silver halide grains may be doped with rhodium, ruthenium, iridium or other Group VIII metals either alone or in combination, preferably at levels in the range $10^{-9}$ to $10^{-3}$, preferably $10^{-6}$ to $10^{-3}$ mole metal per mole of silver. The grains may be mono- or poly-disperse. The preferred Group VIII metals are rhodium and/or iridium and ammonium pentachlororhodate may conveniently be used.

The present photographic materials are particularly suitable for exposure by red or infra-red laser diodes, light emitting diodes or gas lasers, e.g. a helium/neon or argon laser.

The light-sensitive silver halide contained in the photographic elements can be processed following exposure to form a visible image by associating the silver halide with an aqueous alkaline medium in the presence of a developing agent contained in the medium or the element. The photographic elements of this invention can be processed in conventional developers as opposed to specialised developers sometimes employed in conjunction with lithographic photographic elements to obtain very high contrast images. When the photographic elements contain incorporated developing agents the elements can be processed in the presence of an activator, which can be identical to the developer in composition, but otherwise lacking a developing agent.

Very high contrast images can be obtained at pH values below 11, preferably in the range of from 10.0 to 10.8, preferably in the range of 10.3 to 10.5 and especially at pH 10.4.

The developers are typically aqueous solutions, although organic solvents, such as diethylene glycol, can also be included to facilitate the solution of organic components. The developers contain one or a combination of conventional developing agents, such as, for example, a polyhydroxybenzene, such as dihydroxybenzene; aminophenol, paraphenylenediamine; ascorbic acid, erythorbic acid and derivatives thereof; pyrazolidone, pyrazolone, pyrimidine, dithionite and hydroxylamine.

It is preferred to employ hydroquinone and 3-pyrazolidone developing agents in combination or an ascorbic acid-based system. An auxiliary developing agent exhibiting superadditive properties may also be used. The pH of the developers can be adjusted with alkali metal hydroxides and carbonates, borax and other basic salts. It is, as previously mentioned, a particular advantage of the present invention that the use of a nucleator as described herein reduces the sensitivity of the photographic material to changes in this developer pH.

To reduce gelatin swelling during development, compounds such as sodium sulfate can be incorporated into the developer. Chelating and sequestering agents, such as ethylenediaminetetraacetic acid or its sodium salt, can be present. Generally any conventional developer can be used in the practice of this invention. Specific illustrative photographic developers are disclosed in the Handbook of Chemistry and Physics, 36$^{th}$ Edition, under the title "Photographic Formulae" at page 30001 et seq. and in "Processing Chemicals and Formulas." 6$^{th}$ Edition, published by Eastman Kodak Company (1963).

The invention will now be described with reference to the following examples which are in no way to be considered as limiting the scope thereof.

EXAMPLE 1

The following preparation of nucleator (M1) is illustrative for the nucleators of this invention of formula (A). All the compounds prepared had infra-red, mass and NMR spectra which were in accordance with pure samples of the desired products.

2,6-Dimethyl-3-(4-[3-morpholinopropylcarbamoylcarbonylhydrazino] phenylsulfamoyl)phenylcarbamoylmethyl 3-(6-Pyrid-3-ylamidohexamethylenecarbamoyl) pyridinium chloride hydrochloride. (M1)

Step1: Ethyl 4-nitrophenylhydrazinooxalate

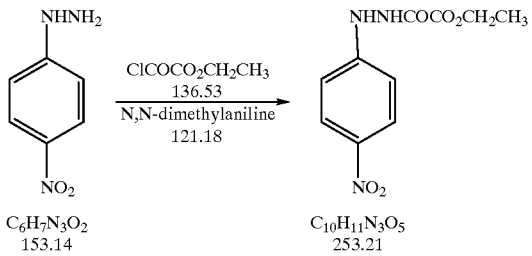

4-Nitrophenylhydrazine (15.31 g, 0.1 mol) was dissolved in a mixture of dry tetrahydrofuran (THF) (100 ml) and dry dimethylformamide (25 ml). N,Ndimethylaniline (12.11 g, 0.1 mol) was added and the dark solution stirred. Ethyl oxalyl chloride (13.65 g, 0.1 mol) in THF (20 ml) was added in a thin stream with stirring. The reaction evolved considerable heat and the temperature of the mixture was maintained at ambient by immersion in an ice/acetone bath. The mixture was stirred at room temperature for 2 h. The volume of the solution was reduced on the rotary evaporator (to about 60 ml) and the mixture run slowly into a stirred mixture of ice/water (420 ml) and concentrated hydrochloric acid (1 ml). The tacky brown solid was filtered, washed with water, dried first at the pump and then in the vacuum oven overnight at 40C over potassium hydroxide. The product was obtained as a brown solid (23.64 g; yield 93.3%).

Step 2: N-(3-Morpholinopropylcarbamoylcarbonyl)-4-nitrophenylhydrazine

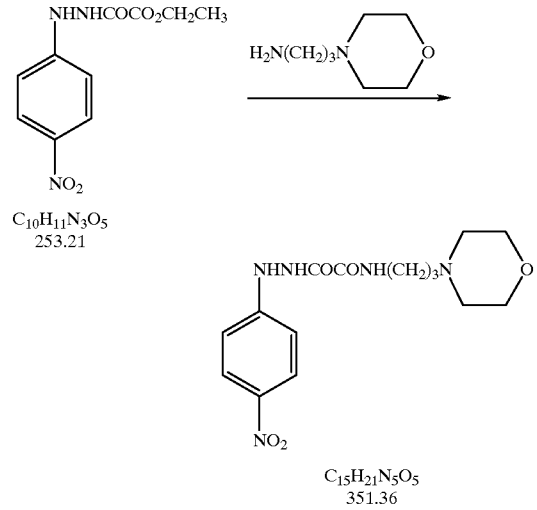

Ethyl 4-nitrophenylhydrazinooxalate (58.9 g, 0.232 mol) was mixed with isopropanol (300 ml) and N-(3-aminopropyl)morpholine (33.54 g, 0.232 mol). The red mixture was heated at reflux for 2 h, checked by MS to ascertain that all the starting material had been consumed and allowed to cool to room temperature. A dark red crystalline deposit was obtained and removed by filtration and air-dried. The product was obtained as a dark red solid (72.73 g; yield 89.2%).

Step 3: 4-Amino-N-(3-morpholinopropylcarbamoylcarbonyl)phenylhydrazine

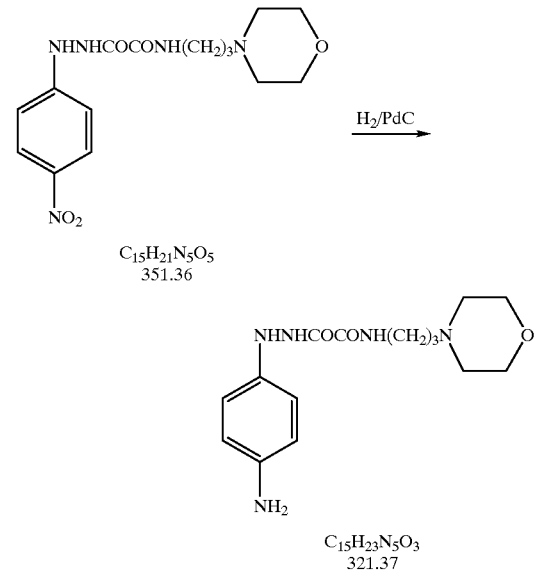

A flask was charged with N-(3-morpholinopropyl-carbamoylcarbonyl)-4-nitrophenylhydrazine (100 g, 0.285 mol) and palladium on charcoal (5 g, 50% wet with water). THF (960 ml) and dimethylacetamide (480 ml) were added and the flask was placed on a CAMILE™ Automated Reactor. A program was run to heat to 55C over 30 min. and a solution of ammonium formate (120 g in 120 ml water) was added over a period of 1 h keeping the temperature at 55C plus or minus 5 degrees. After completion of the addition the mixture was sired and heated at 55C for 2 h, filtered warm (45–50C) through Kieselguhr and the catalyst residue washed with THF. The THF was concentrated off on the rotary evaporator and a heavy, yellow precipitate resulted, which was filtered and washed with isopropanol. The residue was dried (vac/50C) to give a pale yellow solid (54 g; yield 60%)

Step 4: 3-Chloroacetamido-2,4-dimethyl-N-(4-[3-morpholinopropyl-carbamoylcarbonylhydrazino]phenyl)benzenesulfonamide hydrochloride

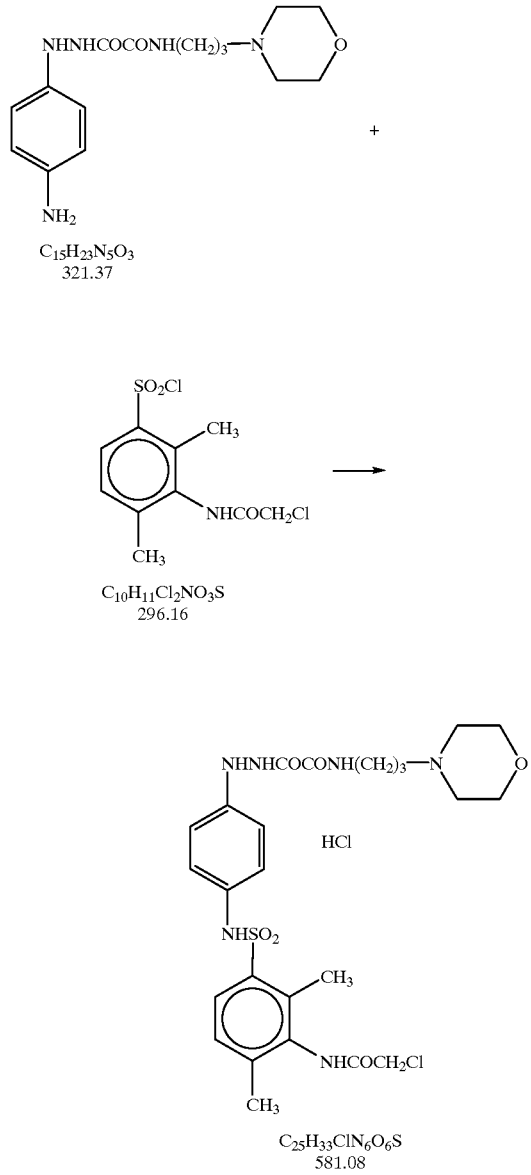

4-Amino-N-(3-morpholinopropylcarbamoylcarbonyl) phenylhydrazine (34.02 g, 0.105 mol) was dissolved in a mixture of THF and dimethylacetamide (120 ml/400 ml) under nitrogen with stirring. 3-Choroacetamido-2,4-dimethylbenzenesulfonyl chloride (31.13 g, 0.105 mol) was added portionwise as a solid while the reaction mixture was stirred and cooled in an ice/acetone bath. The mixture was stirred for several hours. An MS was run which indicated that the required product had been formed. The solution was rotary evaporated to remove the THF. The resulting dimethylacetamide solution was poured into stirred isopropanol (1.5 l). The resulting pink solid was filtered off and dried under vacuum to give a brownish glass (60.03 g, yield 92.6%).

Step 5: 1,6-Dipyrid-3-ylamidohexane

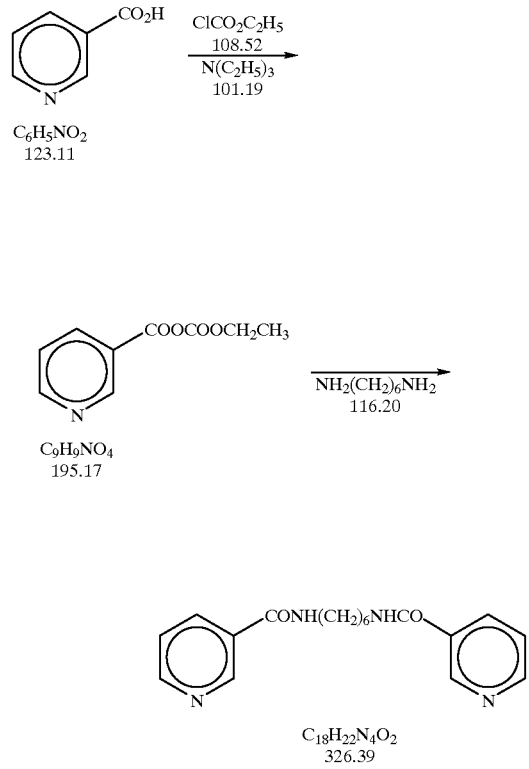

Nicotinic acid (80 g, 0.65 mol) was dissolved in THF (780 ml) and triethylamine (65.63 g, 0.65 mol) was added. The solution was cooled in an ice-bath (0–5C) and ethyl chloroformate (70.53 g, 0.65 mol) was added dropwise, with stirring, over 30 min., keeping the temp below 5C. The mixture was stirred for a further 60 min. at ice-bath temperature and then a solution of 1,6-hexanediamine (37.76 g, 0.325 mol) in acetonitrile (780 ml) was added in one portion. The reaction mixture was stirred at ambient temperature over night then checked by MS to ascertain that the reaction was complete. The white precipitate was removed by filtration and washed well with water to remove triethylamine hydrochloride and any residual traces of nicotinic acid and then dried in vacuum oven at 40C. The product was obtained as a white solid (45.31 g; yield 42.7%).

Step 6: 2,6-Dimethyl-3-(4-[3-morpholinopropylcarbamoylcarbonylhydrazino]-phenylsulfamoyl)phenylcarbamoylmethyl 3-(6-Pyrid-3-ylamidohexamethylenecarbamoyl)pyridinium chloride hydrochloride. (M1).

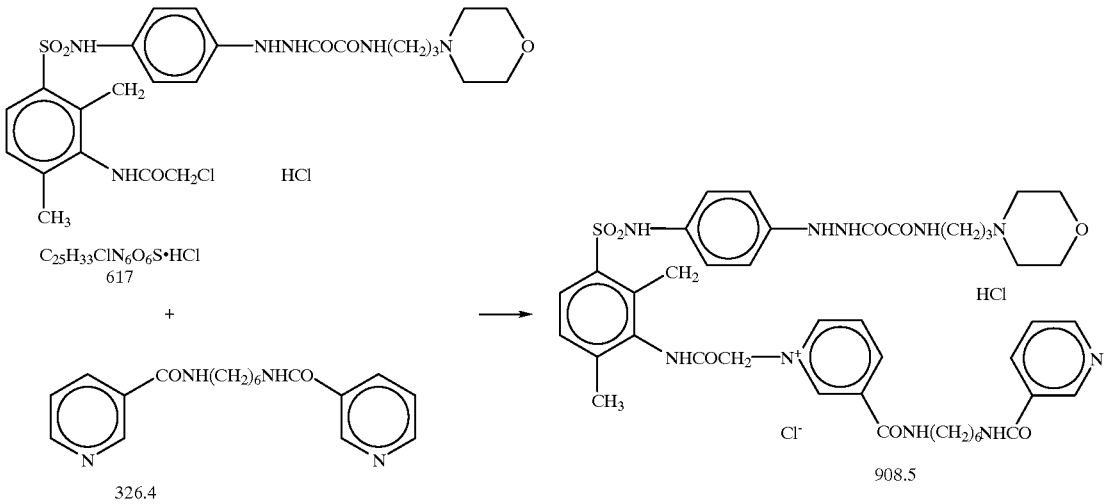

A 250 ml flask was charged with 3-chloroacetamido-2,4-dimethyl-N-(4-[3-morpholinopropylcarbamoylcarbonylhydrazino]phenyl)benzenesulfonamide hydrochloride (16 g, 0.0275 mol) dissolved in 100 ml dimethylacetamide. 1,6-Dipyrid-3-ylamidohexane (9 g, 0.0275 mol) was added and the solution was degassed with nitrogen for 15 min. before being heated to 70C and then held at 70C with stirring under nitrogen for 24 h. The hot reaction mixture was poured into stirred acetonitrile (11). A pinkish precipitate resulted. The mixture was stirred for 1 h before filtering and air drying the product at ambient temperature over night and then under vacuum at 40C. The product was obtained as a brown glass (22.2 g; yield 90%).

The product comprised M1 and N1 in the ratio of 86:14 i.e. it comprised primarily the compound of formula (I).

Different relative proportions of the components can be achieved by varying the amounts of the reactants in step 6. For example doubling the amount of the morpholino compound in that step compared with the dipyridino compound and increasing the reaction temperature results in ratios of (M1):(N1) in the range 80:20 to 90:10, i.e. the compound of formula (II) is then in excess.

EXAMPLE 2

Preparation of Nucleating Agent (M13) and (N8)

Analogously with the above preparation, the following synthetic route for the preparation of the nucleator (M13), is illustrative for the nucleators for this invention of formula (B):

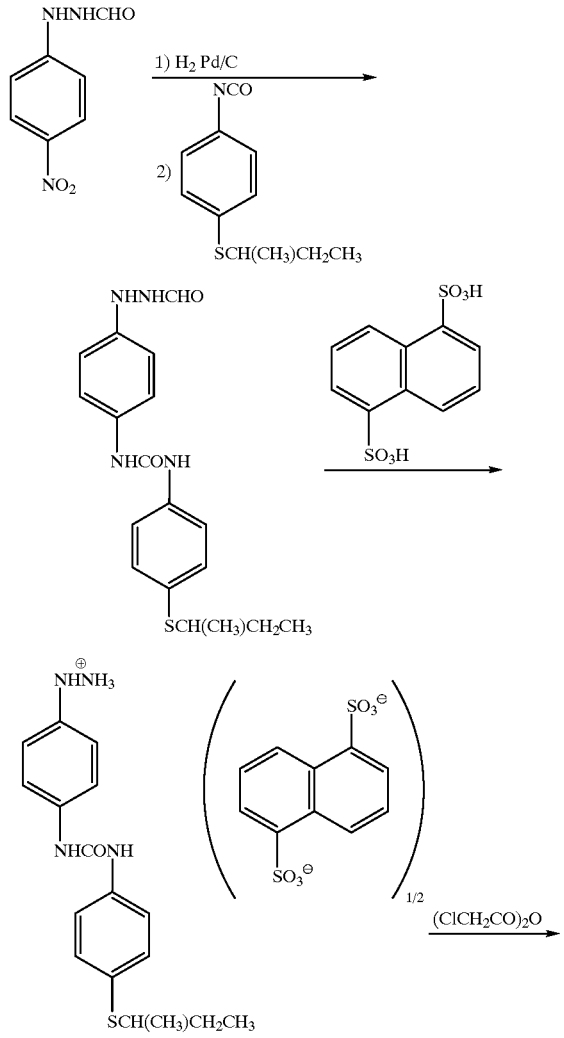

-continued
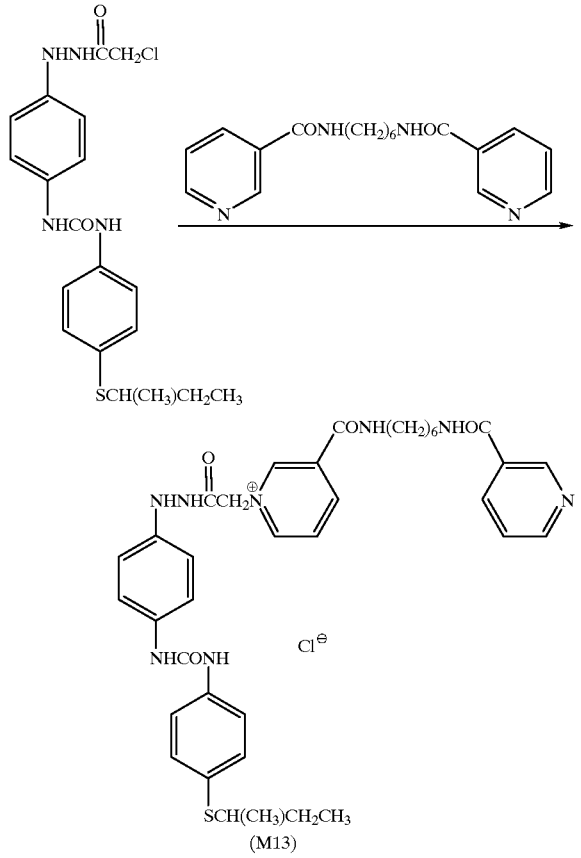
(M13)
This synthesis also produces the dimeric molecule (N8).
EXAMPLE 3
Preparation of Nucleating Agent (M15)
Analogously, the following synthetic route for the preparation of nucleator (M15, is illustrative for the nucleators of this invention of formula (C):
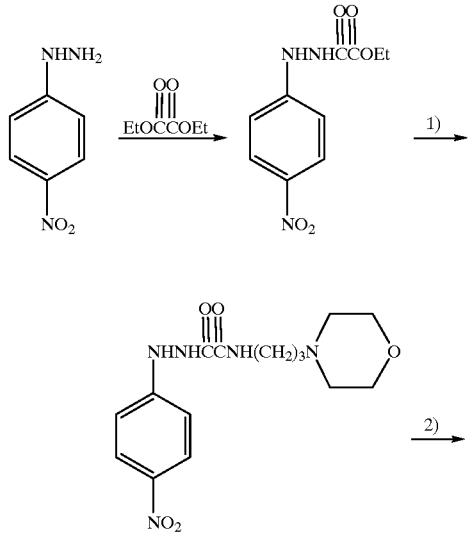
-continued
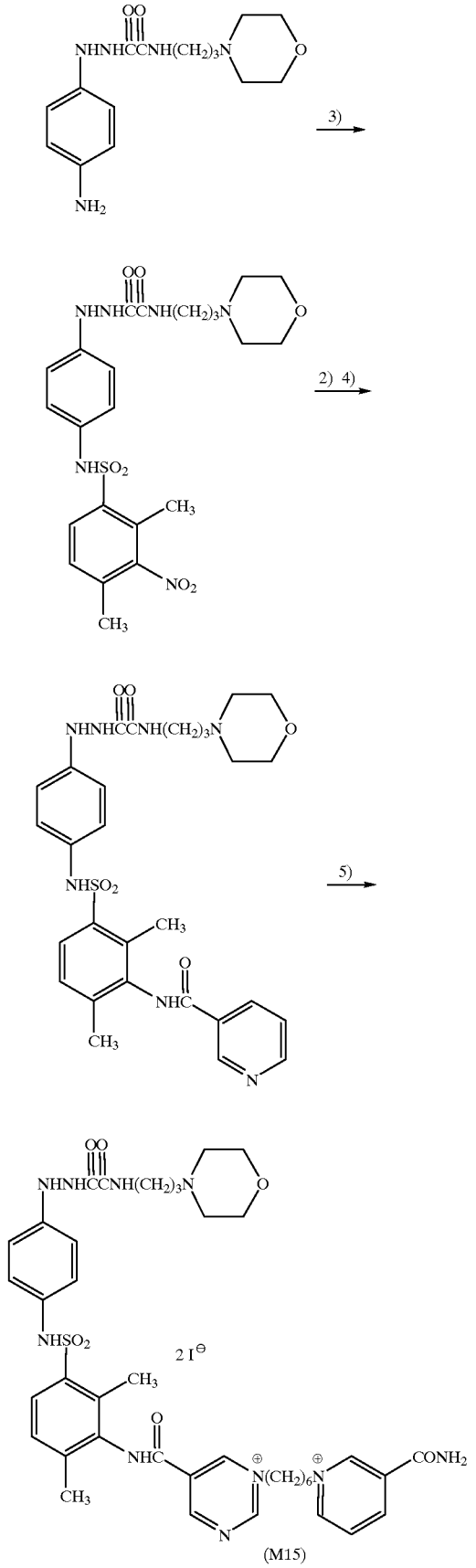
(M15)

-continued

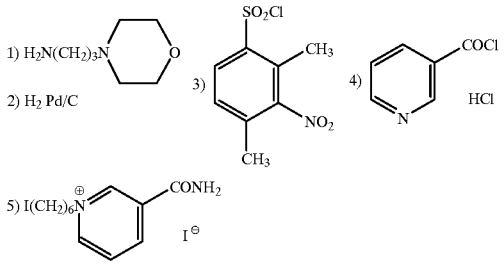

No compound of formula (II) is prepared in this synthesis.

EXAMPLE 4

Preparation of Coatings

The film coatings prepared consisted of a polyethylene terephthalate (ESTAR™) support on which was coated an emulsion layer and a protective gel overcoat.

The emulsion layer consisted of 3.3 g Ag/m$^2$ of a 70:30 chlorobromide cubic monodispersed emulsion (0.18 $\mu$m edge length) uniformly doped with ammonium pentachlororhodate at 0.17 mg/Agmol and chemically sensitized with sulfur and gold, and also included 60 mg/m$^2$ of booster B1.

B1

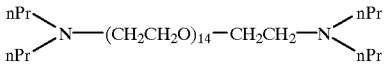

The emulsion was spectrally sensitized with 350 mg/Agmol of 1H-benzimidazole-1-propanesulfonic acid, 2-((1,3-diethyl-tetrahydro-4,6-dioxo-2-thioxo-5(2H)-pyrimidinylidene) ethylidene)-3-ethyl-2,3-dihydro-, sodium salt. Other addenda included were 270 mg/Agmol of 2-mercapto-methyl-5-carboxy-4-hydroxy-6-methyl-1,3,3a,7-tetra-azaindene and 23 mg/Agmol 1-(3-acetamidophenyl)-5-mercaptotetrazole. The layer also contained 2.00 g/m$^2$ gel, and 0.6 g/m$^2$ of copolymer methacrylate: 2-acrylamido-2-methylpropanesulfonic acid: sodium salt of 2-acetoxyethyl-methacrylate (88:5:7 by weight).

Three further coatings were made to the same formulation except that in each instance a solution of nucleating agent was added to the emulsion before coating at a rate sufficient to provide a total nucleating agent concentration of 0.327 g nucleating agent/mol Ag, as follows:

solution A 0.6% of a comparison hydrazide nucleating agent C1, currently used in commercial product, in 30% aqueous methanol;

solution B 0.6% of 82% M1 and 18% N1 in water solution C 0.6% of 8% M1 and 92% N1 in water.

C1 has the formula:

C1

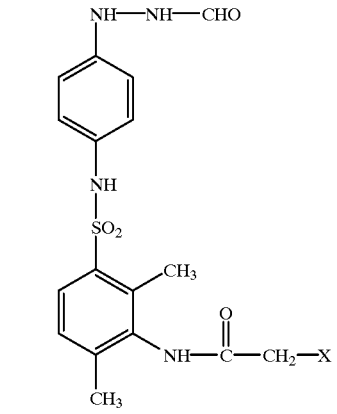

wherein X = S—$(CH_2CH_2O)_4$—$C_8H_{17}$

EXAMPLE 5

Evaluation of Coatings (i) Sensitometric Data

The coatings were evaluated by exposing through a 0.1 increment step wedge with a $10^{-6}$ sec. flash sensitometer fitted with a P11 filter (which simulates an argon-ion laser exposing source) and then processed in Kodak RA2000™ Developer (diluted 1+2) with development times of 20 s. and 40 s. at 35C. Comparisons of the sensitometry for the coatings described above were made as shown in Table I.

TABLE I

Sensitometric and Process latitude data

| Nucl. | Dev. time | $D_{min}$ | $D_{max}$ | Sp2.0 | Gr2.0 |
|---|---|---|---|---|---|
| None | 20s | 0.017 | 6.60 | 1.09 | 15.12 |
| | 40s | 0.024 | 6.85 | 1.21 | 14.63 |
| A | 20s | 0.017 | 6.85 | 1.28 | 18.48 |
| | 40s | 0.024 | 6.85 | 1.55 | 32.78 |
| B | 20s | 0.018 | 6.85 | 1.19 | 18.89 |
| | 40s | 0.021 | 6.85 | 1.27 | 19.53 |
| C | 20s | 0.016 | 6.85 | 1.22 | 26.72 |
| | 40s | 0.020 | 6.85 | 1.30 | 29.75 |

In Table I (and Table II) the following abbreviations are used:

$D_{min}$—minimum density:

$D_{max}$—maximum density

Sp0.6—toe speed, measured as the relative loge exposure required to produce a density of 0.6 above $D_{min}$ Sp2.0—measured as the relative logE exposure required to produce a density of 2.0 above $D_{min}$ PrD—practical density, measured as the density achieved at an exposure 0.4 logE units higher than the Sp0.6 value Gr2.0—measured as the gradient between density points 1.5 and 2.5 above $D_{min}$ USC—upper scale contrast, measured as the gradient between density points 2.5 and 4.0 above $D_{min}$ EC—effective contrast, measured as the gradient between density points 0.1 and 2.5 above $D_{min}$.

Spread—chemical spread, measured as the rate of increase in line width ($\mu$/s) produced when development time is increased from 20 s at 35C.

ii (ii) Sensitometric Evaluation iii It will be seen from Table I that the measured low-density contrast (Gr2.00) for all the nucleated coatings was significantly higher at the same development time than that for the coating with no nucleator present, demonstrating effective nucleation by all the coatings.

However, increasing the development time for the coating containing the comparison nucleator C1 (solution A) caused a large increase in contrast, showing that the system was not robust to changes in processing conditions. With both the solutions B and C, containing nucleating agents according to the invention, the increase in contrast with development time was very much reduced. This reduction in process variability provided by the inventive nucleators is a highly desirable improvement. While solution C (in which N1 predominates) was somewhat more active than solution B (predominantly M1), adequate nucleation, matching that of the comparison nucleator C1, was still observed with solution B.

The increased stability towards process changes was also demonstrated by the measured speed parameters Sp2.0, where again it can be seen that the increased speed observed at the longer process time was smaller for the two coatings using nucleating agents according to the invention than it was for comparison nucleator C1.

EXAMPLE 6

Preparation of Coatings

The film coatings prepared consisted of a polyethylene terephthalate (ESTAR™) support (with an antihalation pelloid layer on its rear surface) on which was coated an emulsion layer, a gel interlayer, and a protective overcoat.

The emulsion layer consisted of 2.8 g Ag/m$^2$ of a 70:30 chlorobromide cubic monodispersed emulsion (0.16 $\mu$m edge length) uniformly doped with ammonium pentachlororhodate at $4.4\times10^{-7}$ moles per Ag mole and dipotassium hexachloroiridate at $6\times10^{-7}$ moles per Ag mole and chemically sensitized with sulfur and gold. The emulsion was spectrally sensitized with 350 mg/Agmol of sensitizing dye S1. Other addenda included were 243 mg/Agmol of 2-mercapto-methyl-5-carboxy-4-hydroxy-6-methyl-1,3,3a,7-tetra-azaindene and 23 mg/Agmol 1-(3-acetamidophenyl)-5-mercaptotetrazole. The layer also contained 1.4 gm$^2$ gel, and 0.4 g/m$^2$ of copolymer methacrylate: 2-acryl-amido-2-methylpropanesulfonic acid: sodium salt of 2-acetoxyethylmethacrylate (88:5:7 by weight).

Senstitizing dye S1, wherein $R_4$ is methyl and $R_5$ is isopropyl

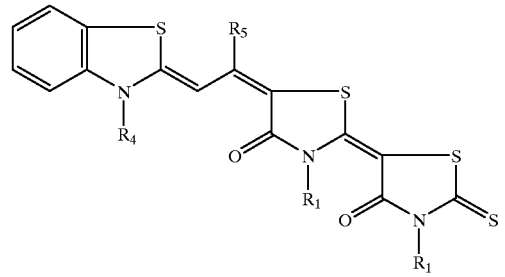

$R_1 = CH_2CO_2H$

An interlayer illustrative of the present invention consisted of 0.65 g/m$^2$ gel, 0.2 g/m$^2$ copolymer methacrylate: 2-acrylamido-2-methylpropane sulfonic acid: sodium salt of 2-acetoxyethyl methacrylate (88:5:7 by weight), 96 mg/m$^2$ 3,5-disulphocatechol, 44 mg/m$^2$ hydroquinone, 7.5 mg/m$^2$ of nucleating agent and 60 mg/m$^2$ booster compound B1.

B1

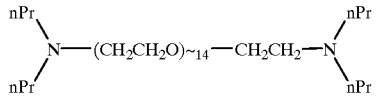

The overcoat contained 1 g/m$^2$ gel with matte beads and surfactants to aid coatability.

Various coatings were made by changing the interlayer formulation as indicated in Table II below. Different nucleating agents were used with variations in the percentage of components of formulae (I) and (II).

EXAMPLE 7

Evaluation of Coatings (i) Sensitometric Data

The coatings were evaluated by exposing through a 0.1 increment step wedge with a $10^{-6}$ s. flash sensitometer fitted with a W29 filter (which simulates an red exposing source) and then processed in Kodak™ RA2000 Developer (diluted 1+2) for 20 s. at 35C. Comparisons of the sensitometry for the coatings described above were made as shown in Table II

TABLE II

Sensitometric data

| Nucl. | Level mg/m$^2$ | II:I ratio | $D_{min}$ | PrD | Sp0.6 | EC | USC | C. Spr. | 20–30s Delta Sp |
|---|---|---|---|---|---|---|---|---|---|
| A | 7.5 | 60:40 | 0.016 | 5.61 | 1.14 | 12.55 | 27.94 | 0.41 | 0.10 |
| B | 7.5 | 64:36 | 0.014 | 5.71 | 1.13 | 14.43 | 33.12 | 0.39 | 0.07 |
| C | 7.5 | 75:25 | 0.013 | 5.75 | 1.15 | 12.04 | 35.13 | 0.42 | 0.08 |
| D | 7.5 | 84:16 | 0.014 | 5.64 | 1.14 | 13.02 | 31.74 | 0.41 | 0.07 |
| E | 7.5 | 87:13 | 0.015 | 5.77 | 1.13 | 13.38 | 37.23 | 0.33 | 0.07 |
| F | 7.5 | 91:9 | 0.015 | 5.70 | 1.13 | 15.17 | 34.38 | 0.36 | 0.07 |
| A | 10 | 60:40 | 0.015 | 5.85 | 1.17 | 14.87 | 31.99 | 0.50 | 0.09 |
| B | 10 | 64:36 | 0.016 | 5.72 | 1.15 | 14.83 | 27.63 | 0.46 | 0.09 |
| C | 10 | 75:25 | 0.015 | 5.74 | 1.17 | 14.99 | 31.71 | 0.46 | 0.08 |
| D | 10 | 84:16 | 0.013 | 5.88 | 1.17 | 14.25 | 31.21 | 0.46 | 0.08 |
| E | 10 | 87:13 | 0.014 | 5.84 | 1.15 | 14.67 | 31.34 | 0.50 | 0.08 |
| F | 10 | 91:9 | 0.015 | 5.86 | 1.16 | 13.83 | 32.53 | 0.45 | 0.08 |

(ii) Sensitometric Evaluation

From the data presented it was clear that there were only small differences (generally within experimental error) between the samples containing the variations in compounds of formulae (I) and (II).

All the samples coated showed values for the effective contrast (EC) over 10 showing good nucleation, producing high contrast and good dot quality. The upper scale contrast (USC) indicated a very high shoulder contrast with all samples. The $D_{min}$ values were all minimal and the practical density figures above 5 showing good density achieved and the chemical spread was within acceptable limits.

(iii) Process Latitude Evaluation

The coatings tabulated above were also evaluated for process latitude to development time. The results are also shown in Table II wherein it was seen that there is negligible variation in speed between a development time of 20 s. and 30 s.

What is claimed is:

1. An ultrahigh contrast photographic material comprising a support bearing a silver halide emulsion layer, containing a hydrazide nucleating agent in the emulsion layer or a hydrophilic colloid layer, wherein the nucleating agent comprises (a) two nicotinamide moieties, which may be the same or different, which are linked by a linking group, and (b) a hydrazide moiety linked to only one of the nicotinamide moieties.

2. The photographic material claimed in claim 1 wherein said nucleating agent has one of the formulae:

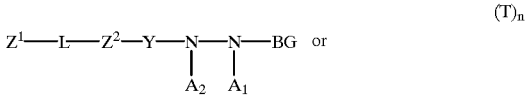

$$Z^1—L—Z^2—Y—\underset{\underset{A_2}{|}}{N}—\underset{\underset{A_1}{|}}{N}—BG \quad (T)_n \quad \text{or}$$

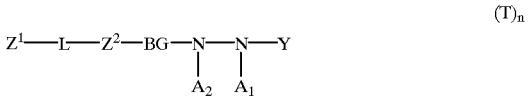

$$Z^1—L—Z^2—BG—\underset{\underset{A_2}{|}}{N}—\underset{\underset{A_1}{|}}{N}—Y \quad (T)_n$$

wherein $Z^1$ and $Z^2$ are the same or different and each is a nicotinamide residue, at least one of which is positively charged;

Y is a substituted aryl or heterocyclic ring;

one of $A_1$ and $A_2$ is a hydrogen atom and the other is a hydrogen atom, an acyl group or an alkyl- or aryl-sulfonyl group, any of which groups may be substituted;

BG is a blocking group;

L is a linking group;

T is an anionic counterion; and n is 1 or 2.

3. The photographic material claimed in claim 1 wherein said nucleating agent has one of the formulae:

(A)

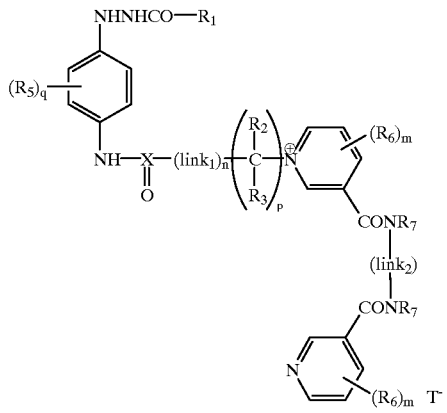

(B)

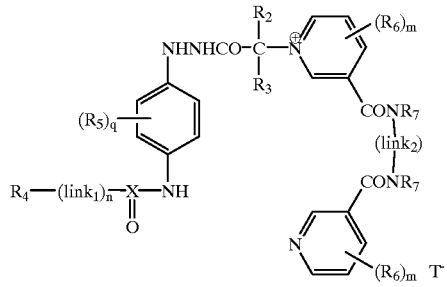

(C)

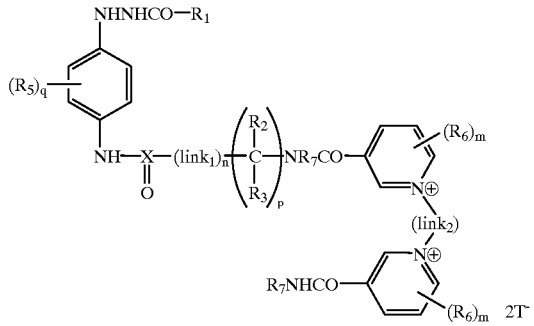

wherein $R_1CO$ comprises a blocking group and $R_1$ is selected from a hydrogen atom, and an unsubstituted or substituted alkyl, aryl, alkoxy, aryloxy, alkoxy- or aryloxy-carbonyl and alkyl- or aryl-aminocarbonyl group; or $R_1$ is or contains an unsubstituted or substituted heterocyclic group, having a 5- or 6-membered ring containing at least one nitrogen, oxygen or sulfur atom, wherein the ring may be linked either directly to the carbonyl group or via an alkyl, alkoxy, carbonyl, amino- or alkylamino-carbonyl group and wherein the ring may be fused to an unsubstituted or substituted benzene ring;

$R_2$ and $R_3$ are independently selected from hydrogen and an unsubstituted or substituted alkyl or aryl group and p is 0 or 1;

$R_4$ and $R_5$ and each $R_6$, which may be the same or different, are independently selected from hydrogen, halogen, hydroxy, cyano and an unsubstituted or substituted alkyl, aryl, heterocyclyl, alkoxy, acyloxy, aryloxy, carbonamido, sulfonamido, ureido, thioureido, semicarbazido, thiosemicarbazido, urethane, quaternary ammonium, alkyl- or aryl-thio, alkyl- or aryl-sulfonyl, alkyl- or aryl-sulfinyl, carboxyl, alkoxy- or aryloxy-carbonyl, carbamoyl, sulfamoyl, phosphonamido, diacylamino, imido or acylurea group, a group containing a selenium or a tellurium atom and a group having a tertiary sulfonium structure;

each m is the same or different and is an integer from 0 to 4;

q is an integer from 0 to 4;

each $R_7$ is the same or different and is independently selected from hydrogen and an unsubstituted or substituted alkyl or aryl group X is selected from C, S═O and C—NH;

($link_1$) is selected from an unsubstituted or substituted alkylene, polyalkylene, aryl, arylaminocarbonyl or heterocyclyl group and n is 0 or 1; and ($link_2$) is a linking group selected from an unsubstituted or substituted polyalkylene, polyalkylene oxide, polyalkylene containing one or more heteroatoms selected from nitrogen, oxygen and sulfur, separated from each other by alkylene groups, or an unsubstituted or substituted polyalkylene in which the alkylene groups are separated by an unsubstituted or substituted aryl or heterocyclic ring and $T^-$ is an anionic counterion.

4. The photographic material claimed in claim 3 wherein $R_1$ is a hydrogen atom or a methyl, trifluoromethyl, 3-methyl-sulfonamidopropyl, methyl- or phenyl-sulfonylmethyl, carboxytetrafluoroethyl, phenyl, 3,5-dichlorophenyl, o-methanesulfonamidophenyl, 4-methanesulfonyl-phenyl, 2(2'-hydroxyethyl)phenyl, 2-hydroxy-4-methylphenyl, 2-hydroxymethyl-phenyl, o-hydroxybenzyl, alkylamino-, alkoxy-, aryloxy- or hydroxyalkylamino-carbonyl; or contains an imidazolyl, pyrazolyl, triazolyl, tetrazolyl, pyridyl, pyridinium, piperidinyl, morpholino, quinolinium or a quinolinyl, phenyl-mercaptotetrazole or a 5- or 6-nitroindazole group.

5. The photographic material claimed in claim 4 wherein $R_1$ is the group —$CONH(CH_2)_n$-morpholino, wherein n is 0 to 4.

6. The photographic material claimed in claim 3 wherein $R_2$ and $R_3$ are independently selected from hydrogen atoms or alkyl groups.

7. The photographic material claimed in claim 3 wherein $R_4$, $R_5$ and $R_6$ are independently selected from hydrogen, alkyl, alkoxy, alkylthio, trifluoromethyl or methylsulfonamido groups.

8. The photographic material claimed in claim 3 wherein $R_7$ is hydrogen, an alkyl group or an alkyl group substituted with a dialkylamino group.

9. The photographic material claimed in claim 3 wherein X is S═O or C—NH and n is 1.

10. The photographic material claimed in claim 3 wherein X is C and n is 0.

11. The photographic material claimed in claim 3 wherein ($link_1$) comprises an unsubstituted or substituted arylamino group or an arylaminocarbonyl group.

12. The photographic material claimed in claim 3 wherein ($link_2$) comprises a $(CH_2)_4$, $(CH_2)_6$, $(CH_2)_2S(CH_2)_2$, $(CH_2)_2O(CH_2)_2O(CH_2)_2$, $(CH_2CH_2O)_{14}CH_2CH_2$ or $CH_2C_6H_4CH_2$ group.

13. The photographic material claimed in claim 1 wherein said nucleating agent has the formula:

(M1)

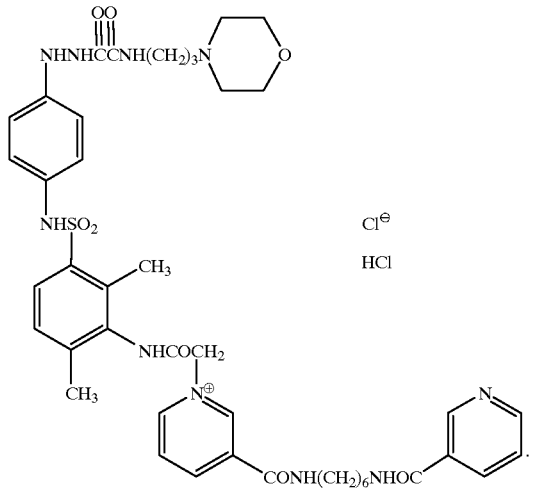

14. The photographic material claimed in claim 1 wherein said nucleating agent of formula (I) is in combination with a nucleating agent of formula (II), which comprises a dimeric molecule comprising two monomers linked by a linking group, each monomer of which (a) may be the same or different and (b) comprises a hydrazide moiety and a nicotinamide moiety.

15. The photographic material claimed in claim 14 wherein said nucleating agent of formula (II) has one of the formulae:

2T

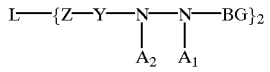

or

2T

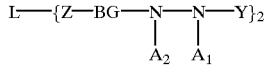

wherein each monomer linked by linking group L is the same or different;

Z is a positively charged nicotinamide residue;

Y is a substituted aryl or heterocyclic ring;

one of $A_1$ and $A_2$ is a hydrogen atom and the other is a hydrogen atom, an acyl group or an alkyl- or aryl-sulfonyl group, any of which groups may be substituted;

BG is a blocking group;

L is a linking group;

T is an anionic counterion; and n is 1 or 2.

16. The photographic material claimed in claim 15 wherein said nucleating agent of formula (II) has one of the formulae:

(D)

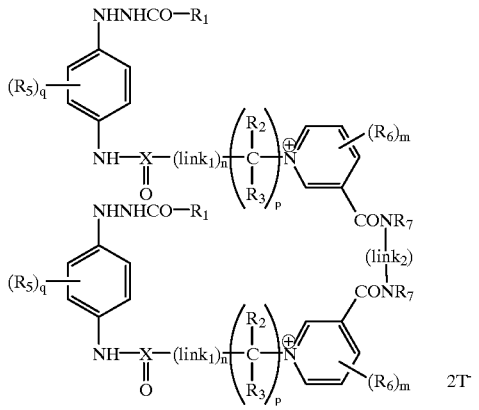

(E)

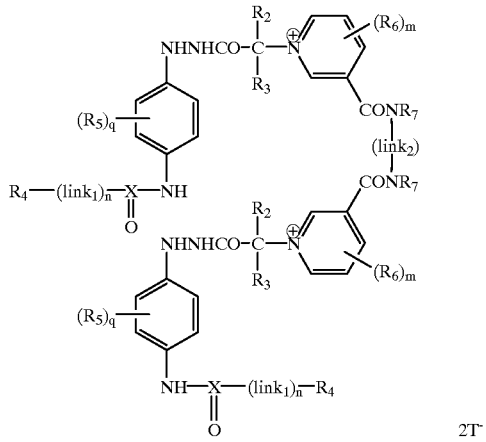

(F)

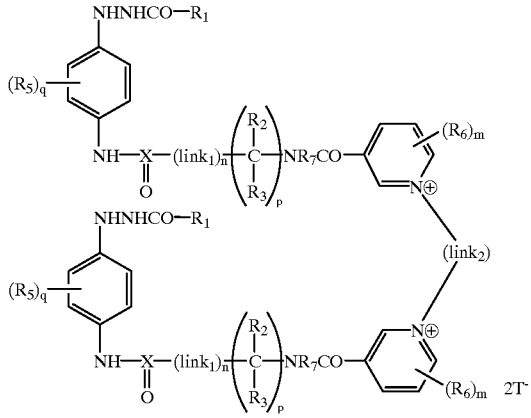

wherein $R_1CO$ comprises a blocking group and each $R_1$ is independently selected from a hydrogen atom, and an unsubstituted or substituted alkyl, aryl, alkoxy, aryloxy, alkoxy- or aryloxy-carbonyl and alkyl- or aryl-aminocarbonyl group; or $R_1$ is or contains an unsubstituted or substituted heterocyclic group, having a 5- or 6-membered ring containing at least one nitrogen, oxygen or sulfur atom, wherein the ring may be linked either directly to the carbonyl group or via an alkyl, alkoxy, carbonyl, amino- or alkylamino-carbonyl group and wherein the ring may be fused to an unsubstituted or substituted benzene ring;

each $R_2$ and $R_3$ are independently selected from hydrogen and an unsubstituted or substituted alkyl or aryl group and p is 0 or 1;

each $R_4$ and $R_5$ and $R_6$ are the same or different and are independently selected from hydrogen, halogen, hydroxy, cyano and an unsubstituted or substituted alkyl, aryl, heterocyclyl, alkoxy, acyloxy, aryloxy, carbonamido, sulfonamido, ureido, thioureido, semicarbazido, thiosemicarbazido, urethane, quaternary ammonium, alkyl- or aryl-thio, alkyl- or aryl-sulfonyl, alkyl- or aryl-sulfinyl, carboxyl, alkoxy- or aryloxy-carbonyl, carbamoyl, sulfamoyl, phosphonamido, diacylamino, imido or acylurea group, a group containing a selenium or a tellurium atom and a group having a tertiary sulfonium structure;

each m is the same or different and is an integer from 0 to 4;

q is an integer from 0 to 4;

each $R_7$ is the same or different and is independently selected from hydrogen and an unsubstituted or substituted alkyl or aryl group each X is selected from C, S═O and C—NH;

$(link_1)$ is independently selected from an unsubstituted or substituted alkylene, polyalkylene, aryl, arylaminocarbonyl or heterocyclyl group and n is 0 or 1; and $(link_2)$ is a linking group independently selected from an unsubstituted or substituted polyalkylene, polyalkylene oxide, polyalkylene containing one or more heteroatoms selected from nitrogen, oxygen and sulfur, separated from each other by alkylene groups, or an unsubstituted or substituted polyalkylene in which the alkylene groups are separated by an unsubstituted or substituted aryl or heterocyclic ring and $T^-$ is an anionic counterion.

17. The photographic material claimed in claim 16 wherein said nucleating agent of formula (II) has the formula:

(N1)

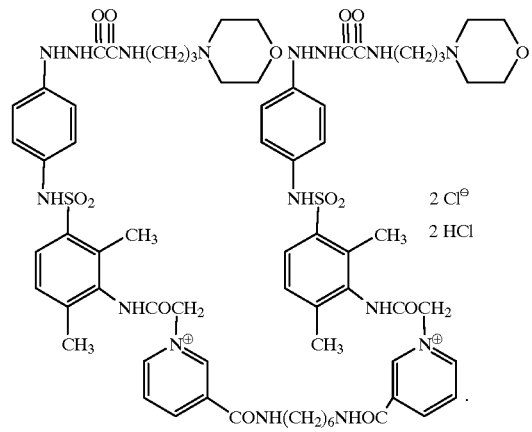

18. The photographic material claimed in claim 1 wherein said nucleating agent comprises a combination of the compounds (M1)

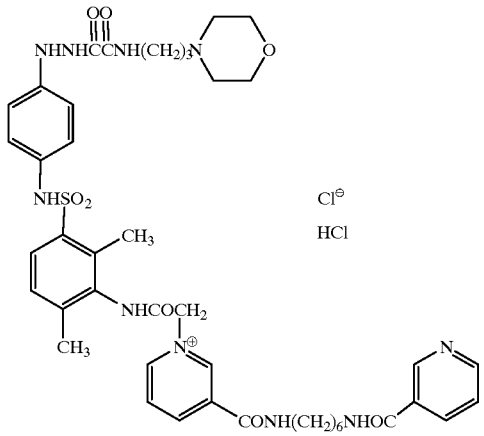

and (N1)

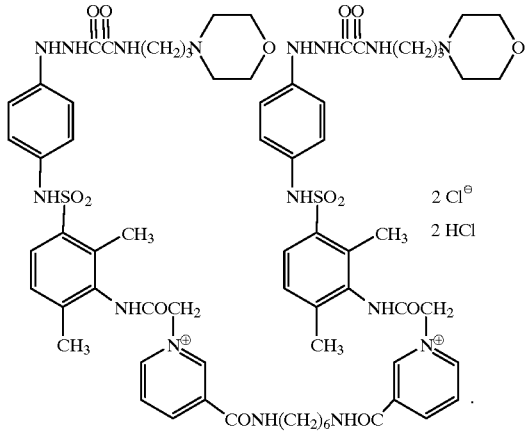

19. The photographic material claimed in claim 1 wherein it also contains, in the emulsion layer or a hydrophilic colloid layer, a booster compound.

20. The photographic material claimed in claim 19 wherein said booster compound is an amine booster.

21. The photographic material claimed in claim 20 wherein said booster compound is

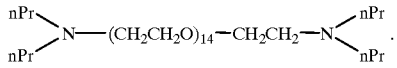

22. The photographic material claimed in claim 1 wherein said nucleating agent is present in the photographic material in an amount of from about 1 $\mu$mol/m$^2$ to about 100 $\mu$mol/m$^2$.

23. The photographic material claimed in claim 14 wherein said nucleating agents are present in the photographic material in a total amount of from about 1 $\mu$mol/m$^2$ to about 100 $\mu$mol/m$^2$.

24. The photographic material claimed in claim 14 wherein the relative proportion of compound of formula (I) to formula (II) is from about 10:90 to about 90:10.

25. The photographic material claimed in claim 24 wherein the amount of compound of formula (II) is greater than the amount of formula (I) and the relative proportion of compound of formula (I) to formula (II) is from about 15:85 to about 30:70.

26. The process of forming a photographic image having ultrahigh contrast which comprises imagewise exposing a photographic material comprising a support bearing a silver halide emulsion layer and processing it with an alkaline developer wherein it is developed in the presence of a nucleating agent as defined in claims 1 or a combination of nucleating agents as defined in claim 14.

27. The process claimed in claim 26 wherein said photographic material is developed in the presence of a booster compound.

* * * * *